US011756369B2

(12) United States Patent
McKeever et al.

(10) Patent No.: US 11,756,369 B2
(45) Date of Patent: Sep. 12, 2023

(54) GRAPHICAL USER INTERFACE FOR HORSE RACE BETTING AND/OR HORSE BREEDING USING TARGETED ANCESTRY-DERIVED RATINGS

(71) Applicant: EQUINEDGE, LLC, Hollywood, FL (US)

(72) Inventors: Scott McKeever, Hollywood, FL (US); Wei-Che Tseng, Hollywood, FL (US); Michael Maiorana, Hollywood, FL (US)

(73) Assignee: EQUINEDGE, LLC, Fort Lauderdale, FL (US)

( * ) Notice: Subject to any disclaimer, the term of this patent is extended or adjusted under 35 U.S.C. 154(b) by 0 days.

(21) Appl. No.: 17/394,691

(22) Filed: Aug. 5, 2021

(65) Prior Publication Data

US 2023/0045168 A1 Feb. 9, 2023

(51) Int. Cl.
*G07F 17/32* (2006.01)
*G06Q 50/34* (2012.01)

(52) U.S. Cl.
CPC ..... *G07F 17/3211* (2013.01); *G06Q 50/34* (2013.01); *G07F 17/3209* (2013.01); *G07F 17/3288* (2013.01)

(58) Field of Classification Search
CPC ..... G07F 17/323; G07F 17/3288; G07F 17/3211; G07F 17/3209; G06Q 50/34
See application file for complete search history.

(56) References Cited

U.S. PATENT DOCUMENTS

2002/0003506 A1* 1/2002 Freiberger ..... G09F 27/00 345/2.1
2002/0037760 A1* 3/2002 Kawamura ..... G07F 17/3288 463/6
2002/0065120 A1 5/2002 Lee et al.
2003/0129630 A1* 7/2003 Aakalu ..... C12Q 1/6876 435/6.16
2003/0144046 A1 7/2003 Hara
2010/0331066 A1 12/2010 Jung et al.
(Continued)

OTHER PUBLICATIONS

"Betmix Angler", video, posted on Jul. 28, 2016 at https://www.youtube.com/watch?v=PcP2YD4SIP0 (Year: 2016).*
(Continued)

*Primary Examiner* — James S. McClellan
*Assistant Examiner* — Ross A Williams
(74) *Attorney, Agent, or Firm* — Stetina Brunda Garred & Brucker

(57) ABSTRACT

A method of generating a graphical user interface for horse race betting includes querying a database to obtain race data associated with a selected race, the race data including a list of horses scheduled to run the selected race, a track surface associated with the selected race, and a distance of the selected race. For each horse from among the list of horses, the method may include selecting a rating corresponding to the horse, the track surface, and the distance, the rating being selected from a plurality of ratings quantifying an expected performance of the horse for different combinations of track surface and distance and being derived from data associated with a sire and/or a dam of the horse. The method may include displaying the list of horses and displaying the selected ratings in association with the horses.

23 Claims, 14 Drawing Sheets

(56) References Cited

U.S. PATENT DOCUMENTS

| | | | | |
|---|---|---|---|---|
| 2015/0213684 | A1 | 7/2015 | Daruty et al. | |
| 2015/0279164 | A1 | 10/2015 | Miller et al. | |
| 2019/0340879 | A1* | 11/2019 | Williams | G07F 17/3225 |
| 2020/0105107 | A1* | 4/2020 | McKeever | G07F 17/3244 |

OTHER PUBLICATIONS

International Search Report for PCT/US2019/053984; dated Dec. 5, 2019.
International Search Report for PCT/US2021/44930; dated Nov. 16, 2021.

* cited by examiner

850

HORSE 1

BIG DREAMING

| | 870Y | 4.5F | 5F | 5.5F | 6F | 6.5F | 7F | 7.5F | 8F | 8.5F | 9F | 10F | 10.5F+ |
|---|---|---|---|---|---|---|---|---|---|---|---|---|---|
| DIRT | 52 | 66 | 60 | 56 | 65 | 73 | 70 | 65 | 75 | 85 | 67 | 76 | 82 |
| TURF | 59 | 68 | 64 | 75 | 65 | 65 | 74 | 70 | 80 | 79 | 76 | 71 | 76 |
| SYNTH | 24 | 41 | 62 | 61 | 60 | 66 | 62 | 65 | 58 | 60 | 61 | 46 | 50 |
| WET | 45 | 70 | 58 | 61 | 53 | 66 | 65 | 66 | 60 | 75 | 77 | 73 | 67 |

HORSE 2

HORSE 3

FIG. 9

GRAPHICAL USER INTERFACE FOR HORSE RACE BETTING AND/OR HORSE BREEDING USING TARGETED ANCESTRY-DERIVED RATINGS

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally to pari-mutuel horse race betting and, more particularly, to user interfaces for horse race betting and/or horse breeding.

2. Related Art

When betting on a horse race, a bettor typically tries to digest a large amount of information related to the horses running the race, some of which may be continually updated (e.g. on a tote board) as other bettors place bets. In the case of more exotic bets such as daily double or pick 3, 4, 5, 6, the bettor's decision-making process may become even more complex as he or she simultaneously considers multiple consecutive or non-consecutive races. In view of the difficulty of making well-informed bets in one's head or with pencil and paper, various computer-implemented betting tools exist in the marketplace. For example, Daily Racing Form LLC provides an online web application called DRF Bets™ TicketMaker™, available at www.drfticketmaker-.com, which allows a user to construct a ticket for placing various types of bets. However, while such conventional betting tools may display published information such as morning line (M/L) odds to assist the user in choosing horses, they do not provide any real advantage to the user beyond convenience.

Applicant's own U.S. Pat. No. 11,004,310 ("the '310 patent"), entitled "Horse Race Betting Graphical User Interface," describes systems and methods for generating a graphical user interface (GUI) for horse race betting, in which a user wishing to generate a horse race betting ticket may automatically generate a combination of horse selections that maximizes a function of a predicted ticket win percentage. However, while a variety of data and algorithms may be used for determining the predicted win percentages described therein, there remain particular types of data for which more uniquely tailored graphical user interfaces would be advantageous from the perspective of a user. For example, in both the horse breeding and betting contexts, pedigree information such as the Dosage Index of a horse may be useful. However, existing GUIs lack functionality for assisting these different user types with making decisions on the basis of such raw data.

BRIEF SUMMARY

The present disclosure contemplates various systems, methods, and apparatuses for overcoming the above drawbacks accompanying the related art. One aspect of the embodiments of the present disclosure is a non-transitory program storage medium on which are stored instructions executable by a processor or programmable circuit to perform operations for generating a graphical user interface for horse race betting. The operations may comprise displaying a race selection tool by which a user of the graphical user interface may select a horse race and, in response to a user interaction with the race selection tool, querying a database of race data to obtain race data associated with a selected race, the race data including a list of horses scheduled to run the selected race, a track surface associated with the selected race, and a distance of the selected race. The operations may further comprise displaying the list of horses and, for each horse from among the list of horses, selecting a rating corresponding to the horse, the track surface, and the distance, the rating being selected from a plurality of ratings quantifying an expected performance of the horse for different combinations of track surface and distance and being derived from data associated with a sire and/or a dam of the horse. The operations may further comprise displaying the selected ratings in association with the horses.

The operations may comprise displaying a button by which the user may navigate to a detailed view of data associated with one of the horses. The detailed view may include the plurality of ratings for the horse organized according to track surface and distance. The selected rating may be highlighted in the detailed view. The plurality of ratings included in the detailed view may be organized in a grid. The grid may have rows and columns corresponding to distance and track surface, respectively. The columns of the grid may be displayed in separate tabs selectable by the user. The operations may comprise, for each of the tabs associated with a corresponding track surface, selecting an overall rating corresponding to the horse and the track surface, the overall rating being selected from a plurality of overall ratings quantifying an expected performance of the horse for different track surfaces irrespective of distance and being derived from data associated with the sire and/or the dam of the horse. The operations may comprise displaying each of the overall ratings on the tab associated with the corresponding track surface.

The grid may have a first dimension corresponding to distance and a second dimension corresponding to track surface. The second dimension of the grid may be displayed in separate tabs selectable by the user corresponding to different track surfaces. The operations may comprise, for each of the tabs associated with a corresponding track surface, selecting an overall rating corresponding to the horse and the track surface, the overall rating being selected from a plurality of overall ratings quantifying an expected performance of the horse for different track surfaces irrespective of distance and being derived from data associated with the sire and/or the dam of the horse. The operations may comprise displaying each of the overall ratings on the tab associated with the corresponding track surface.

The plurality of ratings for each horse may be two-digit numbers.

The plurality of ratings for each horse may be derived from ancestry data of the horse going back three or more generations. The plurality of ratings for each horse may be derived from performance data of the horse.

The operations may comprise displaying an automatic ticket generation button by which the user may request an automatic selection of horses to generate a horse race betting ticket and, in response to a user interaction with the automatic ticket generation button, marking one or more of the horses as selected to win the race based at least in part on the selected ratings.

Another aspect of the embodiments of the present disclosure is a method of generating a graphical user interface for horse race betting. The method may comprise displaying a race selection tool by which a user of the graphical user interface may select a horse race and, in response to a user interaction with the race selection tool, querying a database of race data to obtain race data associated with a selected race, the race data including a list of horses scheduled to run the selected race, a track surface associated with the selected race, and a distance of the selected race. The method may further comprise displaying the list of horses and, for each horse from among the list of horses, selecting a rating corresponding to the horse, the track surface, and the distance, the rating being selected from a plurality of ratings quantifying an expected performance of the horse for different combinations of track surface and distance and being derived from data associated with a sire and/or a dam of the horse. The method may further comprise displaying the selected ratings in association with the horses.

The method may comprise displaying a button by which the user may navigate to a detailed view of data associated with one of the horses. The detailed view may include the plurality of ratings for the horse organized according to track surface and distance. The plurality of ratings included in the detailed view may be organized in a grid. The grid may have a first dimension corresponding to distance and a second dimension corresponding to track surface. The second dimension of the grid may be displayed in separate tabs selectable by the user corresponding to different track surfaces.

Another aspect of the embodiments of the present disclosure is a system for generating a graphical user interface for horse race betting. The system may comprise one or more servers in communication with a user device and one or more program storage media on which are stored instructions executable by the one or more servers to perform operations for generating a graphical user interface accessible by the user device via a web browser or mobile application of the user device. The operations may comprise displaying a race selection tool by which a user of the graphical user interface may select a horse race and, in response to a user interaction with the race selection tool, querying a database of race data to obtain race data associated with a selected race, the race data including a list of horses scheduled to run the selected race, a track surface associated with the selected race, and a distance of the selected race. The operations may further comprise displaying the list of horses and, for each horse from among the list of horses, selecting a rating corresponding to the horse, the track surface, and the distance, the rating being selected from a plurality of ratings quantifying an expected performance of the horse for different combinations of track surface and distance and being derived from data associated with a sire and/or a dam of the horse. The operations may further comprise displaying the selected ratings in association with the horses.

Another aspect of the embodiments of the present disclosure is a non-transitory program storage medium on which are stored instructions executable by a processor or programmable circuit to perform operations for generating a graphical user interface for horse breeding. The operations may comprise displaying a breeding selection tool by which a user of the graphical user interface may select a sire and a dam and, in response to a user interaction with the breeding selection tool, deriving a plurality of ratings from data associated with the selected sire and data associated with the selected dam, the plurality of ratings quantifying an expected race performance of a foal of the sire and the dam for different combinations of track surface and distance. The operations may further comprise displaying the plurality of ratings.

The displayed ratings may be organized according to track surface and distance. The displayed ratings may be organized in a grid. The grid may have rows and columns corresponding to distance and track surface, respectively. The columns of the grid may be displayed in separate tabs selectable by the user. The operations may comprise, for each of the tabs associated with a corresponding track surface, deriving an overall rating from data associated with the selected sire and data associated with the selected dam, the overall rating quantifying an expected race performance of the foal on the track surface irrespective of distance. The operations may comprise displaying each of the overall ratings on the tab associated with the corresponding track surface.

The grid may have a first dimension corresponding to distance and a second dimension corresponding to track surface. The second dimension of the grid may be displayed in separate tabs selectable by the user corresponding to different track surfaces. The operations may comprise, for each of the tabs associated with a corresponding track surface, deriving an overall rating associated with the selected sire and data associated with the selected dam, the overall rating quantifying an expected race performance of the foal on the track surface irrespective of distance. The operations may comprise displaying each of the overall ratings on the tab associated with the corresponding track surface.

The plurality of ratings may be two-digit numbers.

The plurality of ratings may be derived from ancestry data of the selected sire and the selected dam going back two or more generations.

The breeding selection tool may include a sex selector for selecting a sex of the foal, and the plurality of ratings may be further derived from the selected sex of the foal.

Another aspect of the embodiments of the present disclosure is a method of generating a graphical user interface for horse breeding. The method may comprise displaying a breeding selection tool by which a user of the graphical user interface may select a sire and a dam and, in response to a user interaction with the breeding selection tool, deriving a plurality of ratings from data associated with the selected sire and data associated with the selected dam, the plurality of ratings quantifying an expected race performance of a foal of the sire and the dam for different combinations of track surface and distance. The method may comprise displaying the plurality of ratings.

The displayed ratings may be organized in a grid. The grid may have a first dimension corresponding to distance and a second dimension corresponding to track surface. The second dimension of the grid may be displayed in separate tabs selectable by the user corresponding to different track surfaces.

The plurality of ratings may be two-digit numbers.

The plurality of ratings may be derived from ancestry data of the selected sire and the selected dam going back two or more generations.

The breeding selection tool may include a sex selector for selecting a sex of the foal, and the plurality of ratings may be further derived from the selected sex of the foal.

Another aspect of the embodiments of the present disclosure is a system for generating a graphical user interface for horse race betting. The system may comprise one or more servers in communication with a user device and one or more program storage media on which are stored instructions executable by the one or more servers to perform operations for generating a graphical user interface accessible by the user device via a web browser or mobile application of the user device. The operations may comprise displaying a breeding selection tool by which a user of the graphical user interface may select a sire and a dam and, in response to a user interaction with the breeding selection tool, deriving a plurality of ratings from data associated with the selected sire and data associated with the selected dam, the plurality of ratings quantifying an expected race performance of a foal of the sire and the dam for different combinations of track surface and distance. The operations may further comprise displaying the plurality of ratings.

BRIEF DESCRIPTION OF THE DRAWINGS

These and other features and advantages of the various embodiments disclosed herein will be better understood with respect to the following description and drawings, in which like numbers refer to like parts throughout, and in which:

FIG. 9 shows an example data structure of ancestry rating data referred to by the horse race betting apparatus;

DETAILED DESCRIPTION

The present disclosure encompasses various embodiments of systems, methods, and apparatuses for generating a graphical user interface (GUI) for horse race betting and/or horse breeding. The detailed description set forth below in connection with the appended drawings is intended as a description of several currently contemplated embodiments and is not intended to represent the only form in which the disclosed invention may be developed or utilized. The description sets forth the functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second and the like are used solely to distinguish one from another entity without necessarily requiring or implying any actual such relationship or order between such entities.

Figure 1:
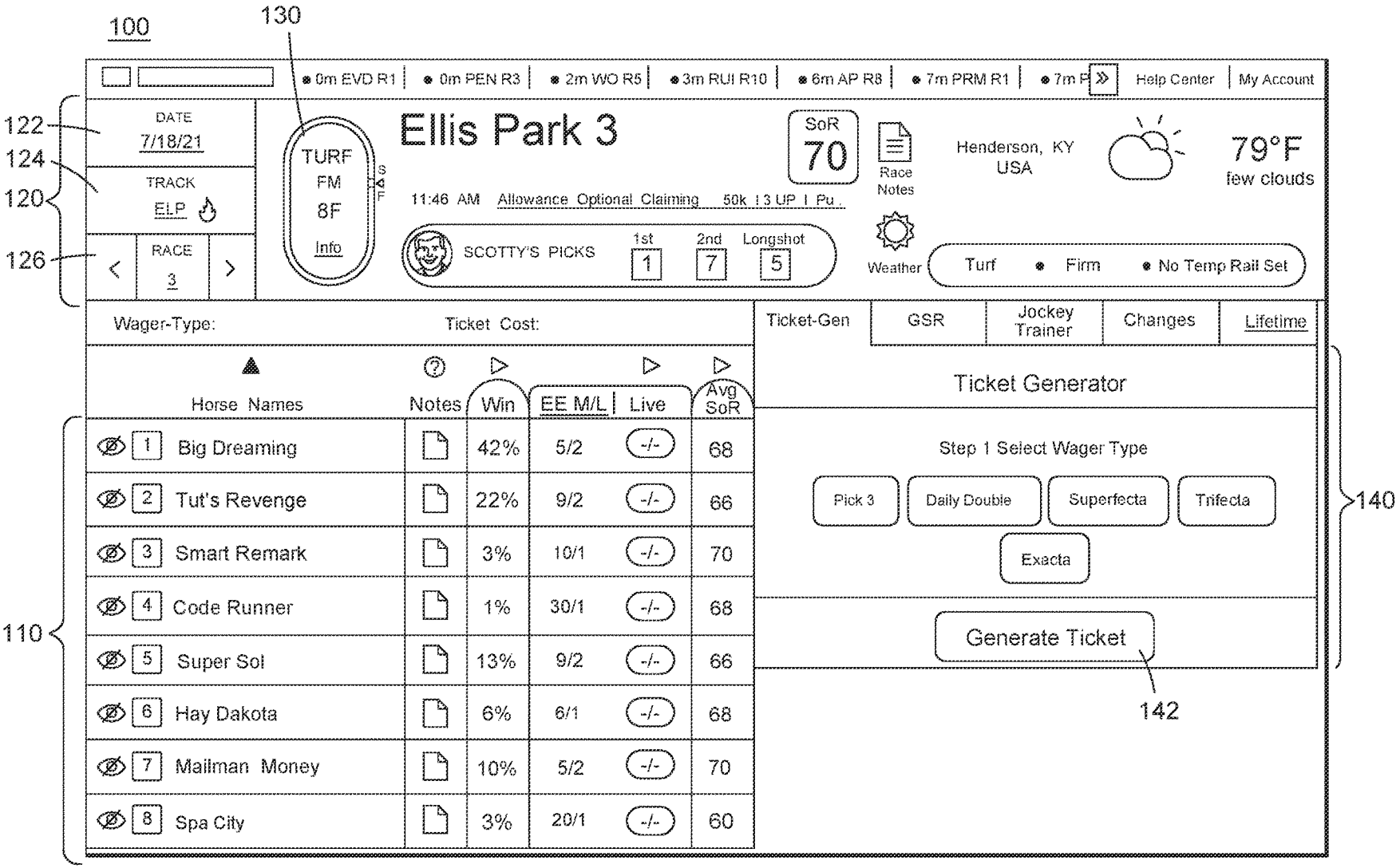
FIG. 1 shows an example view of a horse race betting graphical user interface (GUI) according to an embodiment of the present disclosure.

FIG. 1 shows an example view of a horse race betting GUI 100 according to an embodiment of the present disclosure. The horse race betting GUI 100 may present a user with ancestry-derived ratings of horses that are specifically targeted to the needs of the user. As the user navigates the horse race betting GUI 100 to generate a horse race betting ticket, for example, the horse race betting GUI 100 may provide the most relevant ratings for each horse of interest in light of the particular race parameters in question such as track surface and distance. Thus, unlike conventional systems that provide raw pedigree information, for example, the horse race betting GUI 100 may serve as a tool for assisting bettors and other users with making decisions based on the most relevant ancestry-derived ratings for the user's purpose.

In the example of FIG. 1, a list 110 of horses is shown including horses named "Big Dreaming," "Tut's Revenge," etc. numbered 1 through 8 as shown in a "Horse Names" column of the list 110. The list 110 may represent the horses scheduled to run a particular horse race, in this case "Ellis Park 3" on Jul. 18, 2021 as shown in the upper part of the horse race betting GUI 100. This particular race may be selected by the user using various selectors included in a race selection tool 120 of the horse race betting GUI 100. Here, the user has selected the date Jul. 18, 2021 using the date selector 122, selected the track "ELP" (Ellis Park) using the track selector 124, and selected the race "3" using the race selector 126, resulting in the selection of Ellis Park 3 on Jul. 18, 2021. The selectors 122, 124, 126 of the race selection tool 120 may be dynamically populated menus, such as a calendar tool in the case of the date selector 122, a drop-down menu in the case of the track selector 124, and forward/backward arrows in the case of the race selector 126. Each of the selectors 122, 124, 126 may allow selection from a list of choices that is dynamically populated with actual race data (which itself may be continually updated) as the user makes selections in any order. For example, the user may first select the date "Jul. 18, 2021," e.g., by clicking on a date in a calendar tool or other type of date selector 122, where dates having no scheduled races may be omitted or indicated as unavailable (e.g. grayed out). When the user subsequently selects a track using the track selector 124, the previous selection of a date may cause the track selector 124 to populate with only those tracks having races on the selected date. In the same way, the selected date and track may cause the race selector 126 to populate only with races that are scheduled for the selected date and track.

Based on the user's selections, the list 110 of horses running in the selected race may be displayed as shown. In addition, the horse race betting GUI 100 may display a race summary 130 of the selected race, which may include a track surface associated with the selected race ("TURF" meaning natural grass) as well as a distance of the selected race ("8F" meaning eight furlongs). The race summary 130 may also include additional information about the condition of the track ("FM" meaning firm, "FT" meaning fast, etc.), a visual representation of the shape of the track including the positions of starting line ("S") and finish line ("F"), and a link to more information about the race ("Info"), such as entry requirements for the horses, claiming price, etc. In general, track surfaces may include turf, dirt, and synthetic surfaces, as well as wet surfaces due to rainy days or other track conditions (e.g. soft, yielding, or heavy turf), any of which may be indicated by the race summary 130. Distances may be indicated in yards or furlongs, for example, with typical distances including 870 yards, 4.5 furlongs, 5 furlongs, 5.5 furlongs, 6 furlongs, 6.5 furlongs, 7 furlongs, 7.5 furlongs, 8 furlongs, 8.5 furlongs, 9 furlongs, 10 furlongs, 10.5 furlongs, etc.

The horse race betting GUI 100 may have any or all of the features described in relation to the horse race betting GUI 100 and/or horse race betting GUI 500 of U.S. Pat. No. 11,004,310 ("the '310 patent"), entitled "Horse Race Betting Graphical User Interface," the entire contents of which is expressly incorporated by reference herein. In this regard, most notably, the horse race betting GUI 100 of the present application may likewise be used to generate a horse race betting ticket, which may be accomplished using a ticket generator 140 accessible by a "Ticket-Gen" tab of the horse race betting GUI 100. The ticket generator 140 may automatically generate a ticket based on the user's selection of wager type (e.g. Daily Double, Pick 3, Pick 4, Pick 5, Pick 6, Exacta, Trifecta, Superfecta, Super Hi 5), bet amount, and maximum ticket price or budget. The ticket generator 140 may further allow for manual selections and modifications to the automatically generated ticket and automatic generation of a new ticket within manually imposed constraints as described in the '310 patent. In the case of horizontal wager types, the selected race ("3") may designate the first leg of the horizontal ticket, with the ticket generator 140 allowing the user to page through multiple legs (with the corresponding lists 110 of horses being updated accordingly as the user scrolls). As detailed in the '310 patent, the automatic generation of a ticket may maximize a function of a predicted ticket win percentage, which may be based on predicted win percentages for each horse. As shown in FIG. 1 of the present application, the predicted win percentage for each horse in a given race may also be displayed to the user ("Win" column).

Additional features of the displayed list 110 of horses may include, for each horse, a button for adding a personal note about the horse ("Notes" column), a morning line odds ("EE M/L" column), live odds ("Live" column), and a numerical representation of how competitive previous races that horse has run in have been on average ("Avg SoR" column, where "SoR" stands for "Strength of Race" and is a proprietary term used by EquinEdge, LLC, the applicant of the present patent application). An eliminator button (eye-shaped icon) may also be provided in association with each horse, by which a user may elect to stop watching a particular horse and thus eliminate the horse from consideration when requesting automatic generation of a horse race betting ticket.

Figure 2:
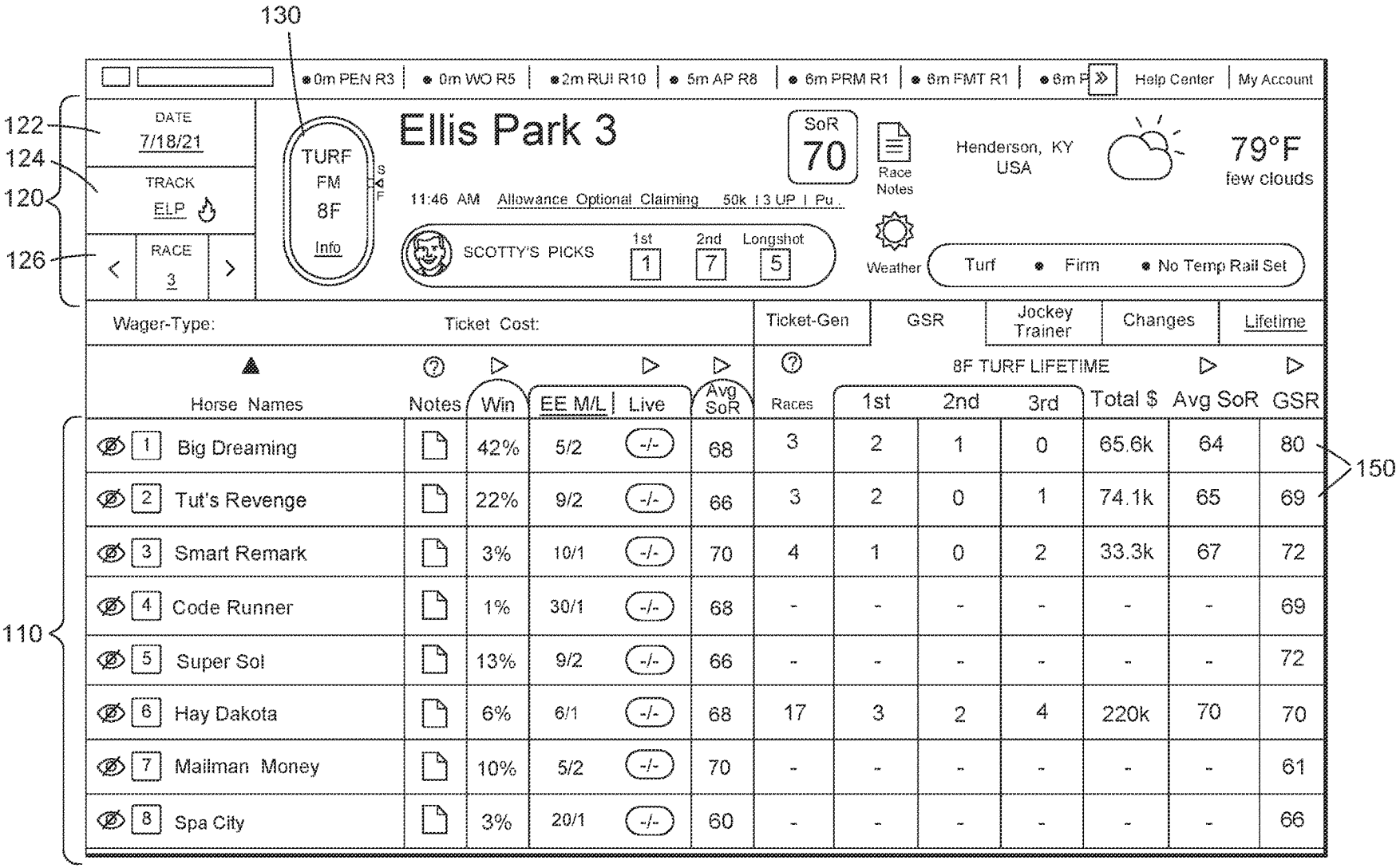
FIG. 2 shows another example view of the horse race betting GUI.

FIG. 2 shows another example view of the horse race betting GUI 100. As noted above, the horse race betting GUI 100 may serve as a tool for assisting bettors and other users with making decisions based on the most relevant ancestry-derived ratings for the user's purpose. To this end, the horse race betting GUI 100 may further display a rating 150 corresponding to each horse in the list 110. The ratings 150, which are displayed under the "GSR" column in FIG. 2, may be accessed, for example, by selecting a "GSR" tab as shown. Selecting the "GSR" tab may replace the ticket generator 140 with additional data about each horse in the list 110, including the ratings 150. The term "GSR" ("Genetic Strength Rating") is a proprietary term used by EquinEdge, LLC, the applicant of the present patent application. Unlike conventional pedigree information, the ratings 150 may be specific not only to each horse but to the particular attributes of the selected race, including track surface (e.g. including track material as well as condition) and distance. Thus, as shown in FIG. 2, the rating 150 and other information is presented under the heading "8F TURF LIFETIME," denoting that the data represents lifetime statistics of each horse for 8-furlong turf races. For example, the horse named "Big Dreaming" has a rating 150 of "80" when running on turf in an 8-furlong race, while the horse named "Tut's Revenge" only has a rating 150 of "69" for the same track surface and distance. If either of these horses appear in a different race having a different track surface or distance, the horse race betting GUI 100 may display a different rating 150 specific to that track surface and distance. Therefore, in a different race, "Tut's Revenge" might have a higher rating than "Big Dreaming."

Additional features that may be displayed for each horse under the heading "8F TURF LIFETIME" (or other specific distance and track surface combination, depending on the selected race) may include a number of races the horse has run in having that particular distance and track surface ("Races" column), how the horse finished in those races ("1st," "2nd," and "3rd" columns), total earnings in those races ("Total $ column"), and a numerical representation of how competitive those particular races were on average ("Avg SoR" column under "8F TURF LIFETIME" heading). For example, in addition to having an ancestry derived rating 150 of "80" on 8-furlong turf races, it can be seen in FIG. 2 that "Big Dreaming" has run three 8-furlong turf races, winning one of them and placing 2nd in the other, totaling $65.6 k earnings, and that the three races had an average competitiveness ("SoR") of "64."

Figure 3:
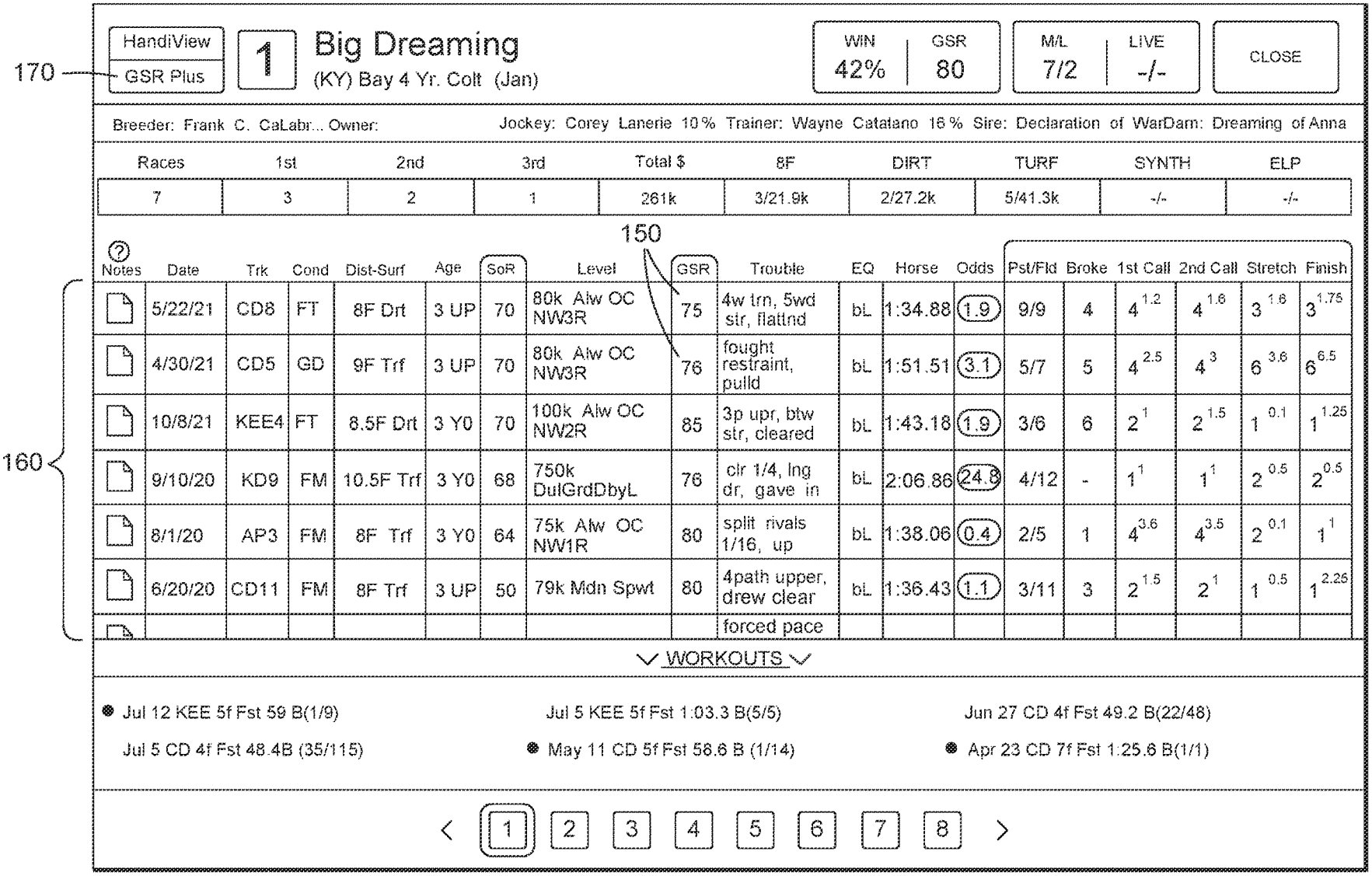
FIG. 3 shows a page of the horse race betting GUI including a detailed view of data associated with a horse.

FIG. 3 shows a page of the horse race betting GUI 100 including a detailed view of data associated with a horse. The page shown in FIG. 3 may be accessed by clicking or tapping the name of a horse in the list 110, for example. In the illustrated example, "Big Dreaming" has been selected in this way, resulting in a detailed view of data associated with this horse, as indicated at the top of the page by the name "Big Dreaming" and the number "1" in large font, which may correspond to the horse's number or post position as indicated in the list 110 shown in FIGS. 1 and 2. As shown at the bottom of FIG. 3, the page may additionally include a horse selector (numbers 1-8 with arrows) allowing easy navigation between detailed information of different horses without having to go back to the previous page showing the list 110. (To navigate back to the previous page, the button labeled "CLOSE" in the top-right corner of FIG. 3 may be used.) In most relevant part, the detailed information shown in FIG. 3 may include a race history 160 for the horse. As can be seen, the ancestry-derived ratings 150 may vary from race to race, even for the same horse, for example, "75" on May 22, 2021, "76" on Apr. 30, 2021, "85" on Oct. 8, 2021, etc. In particular, the ratings 150 may depend on the distance and track surface as shown in the "Dist-Surf" column. For example, on May 22, 2021, the rating 150 was "75" because it was an 8-furlong dirt race, while on Apr. 30, 2021 the rating 150 was "76" because it was a 9-furlong turf race. If the user would like more detailed information concerning the ancestry derived ratings 150, the user may click or tap a button 170 (labeled "GSR Plus") to navigate to another page showing another detailed view of data associated with the selected horse.

Figure 4:
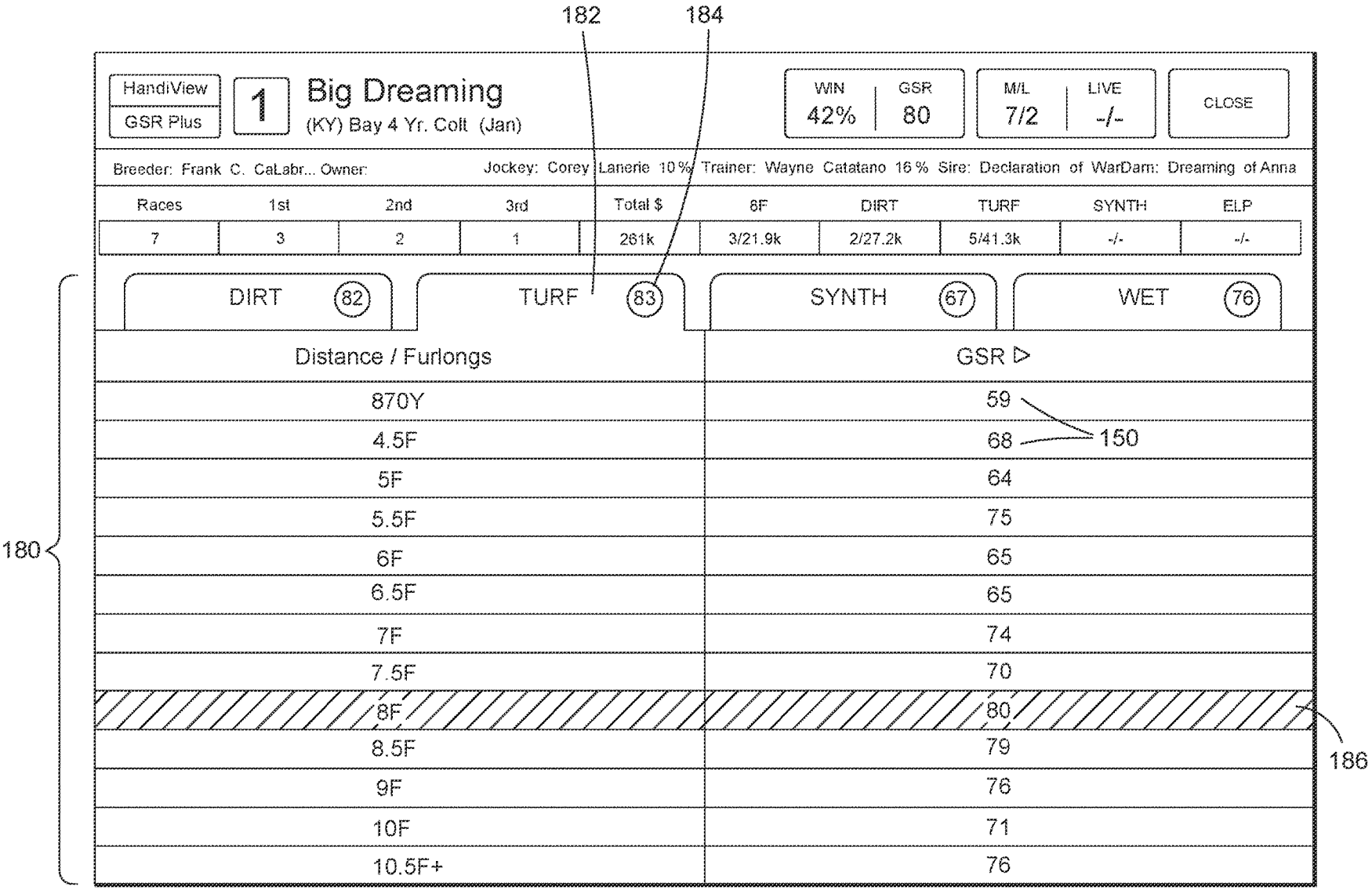
FIG. 4 shows another page of the horse race betting GUI including a detailed view of data associated with the horse.

FIG. 4 shows another page of the horse race betting GUI 100 including a detailed view of data associated with the selected horse. The view of FIG. 4 may be displayed in response to the user's interaction with the button 170 (see FIG. 3). In FIG. 4, the race history 160 of FIG. 3 has been replaced with a detailed view of the plurality of ratings 150 for the horse "Big Dreaming," organized according to track surface ("DIRT," "TURF," "SYNTH," "WET") and distance ("Distance/Furlongs"). In particular, the plurality of ratings included in the detailed view may be organized in a grid 180 as shown, having a first dimension (e.g. rows) and a second dimension (e.g. columns) corresponding to distance and track surface, respectively. In order to make the most efficient use of screen real estate (especially in the case of displaying the horse race betting GUI 100 on a mobile device having a small screen such as a smartphone), one of the two dimensions may be displayed in separate tabs 182 selectable by the user. Because there are typically fewer possible track surfaces than distances, the dimension that is displayed in separate tabs 182 is preferably the second dimension, i.e. the one corresponding to the different track surfaces (though in some cases there may be many different track surfaces including specific condition-defined surfaces such as soft, yielding, or heavy turf). In the specific example shown in FIG. 4, the first dimension of the grid 180 is rows and the second dimension is columns, such that the tabs 182 are displayed along the top of the grid 180. However, it is contemplated that the first dimension may be columns while the second is rows, in which case the tabs 182 may be displayed along the left side of the grid 180, for example.

Upon navigating to the page shown in FIG. 4, the user may immediately see the most relevant of the ancestry-derived ratings 150 for that horse, namely those associated with the track surface for the race in question. In particular, continuing with the example where the user has selected Ellis Park 3 on Jul. 18, 2021 and is viewing detailed information about "Big Dreaming," the user's interaction with the button 170 may cause the horse race betting GUI 100 to display the grid 180 with the tab 182 corresponding to "TURF" initially selected as shown in FIG. 4 (turf being the track surface of the selected race). The rows of the grid 180 may display a series of distances ranging from 870 yards up to 10.5 furlongs, with the horse's ancestry-derived ratings 150 shown for each distance on that particular track surface (turf). Among these, the specific distance of the selected race, 8 furlongs, may be displayed with a highlight 186 in order to draw the user's eye to the most relevant rating 150. This particular rating 150 (i.e. "80") is the same rating 150 that appeared in association with "Big Dreaming" when viewing the list 110 of horses running in the selected race as shown in FIG. 2. By perusing the other ratings 150 shown in the grid 180, the user can get a better understanding of how the particular horse might be expected to perform at different distances other than the distance of the selected race.

Figure 5:
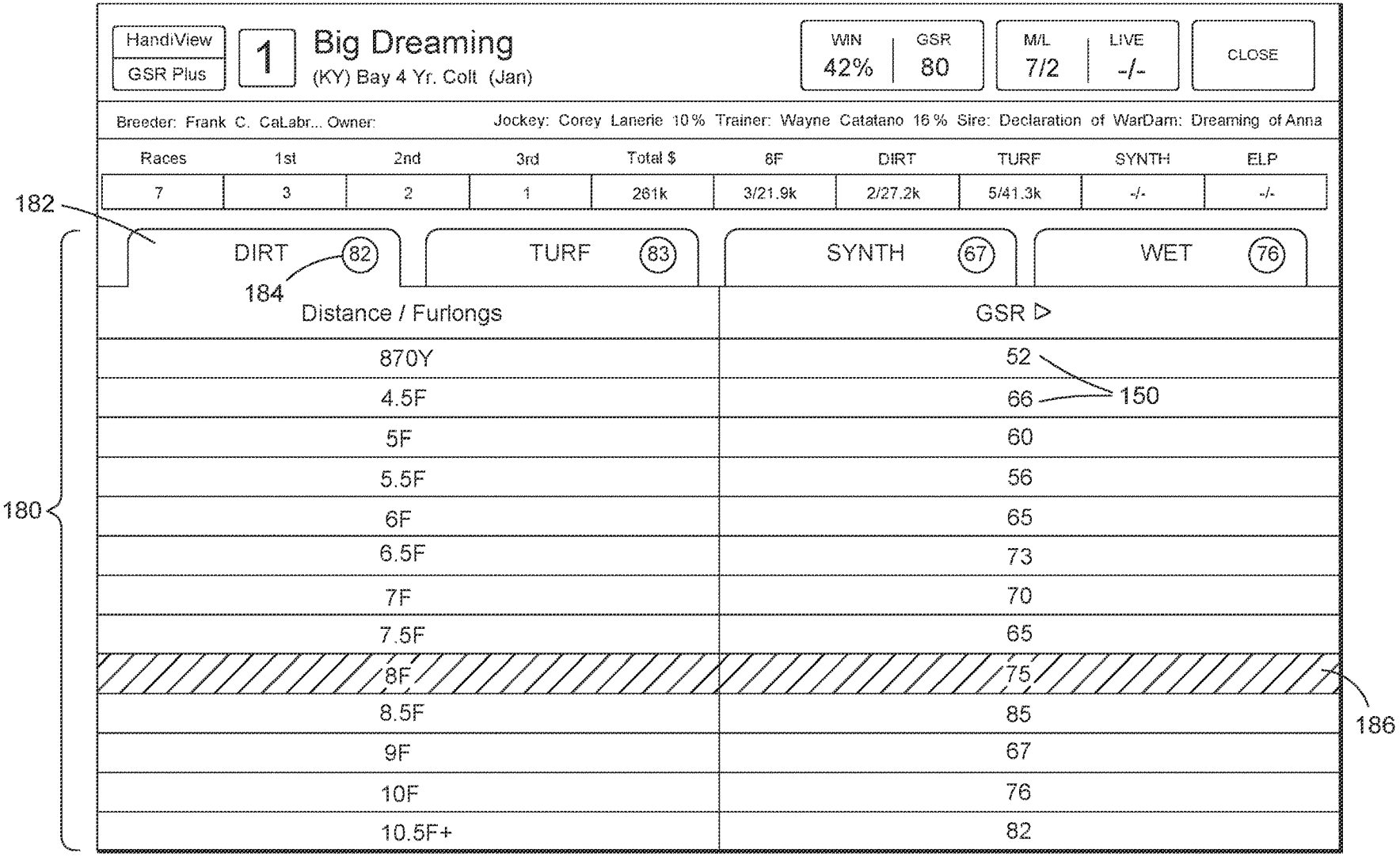
FIG. 5 shows another page of the horse race betting GUI including a detailed view of data associated with the horse.
Figure 6:
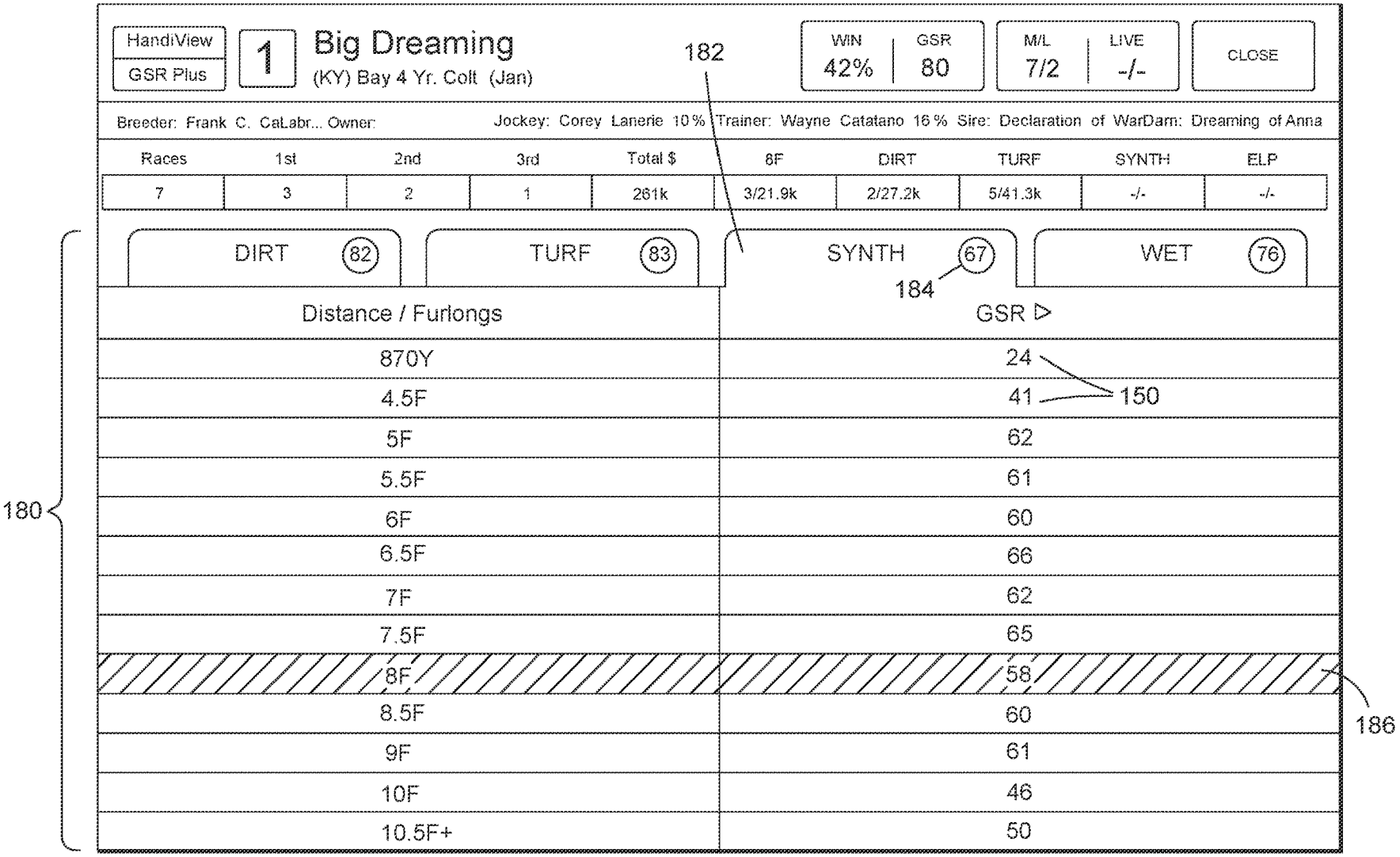
FIG. 6 shows another page of the horse race betting GUI including a detailed view of data associated with the horse.
Figure 7:
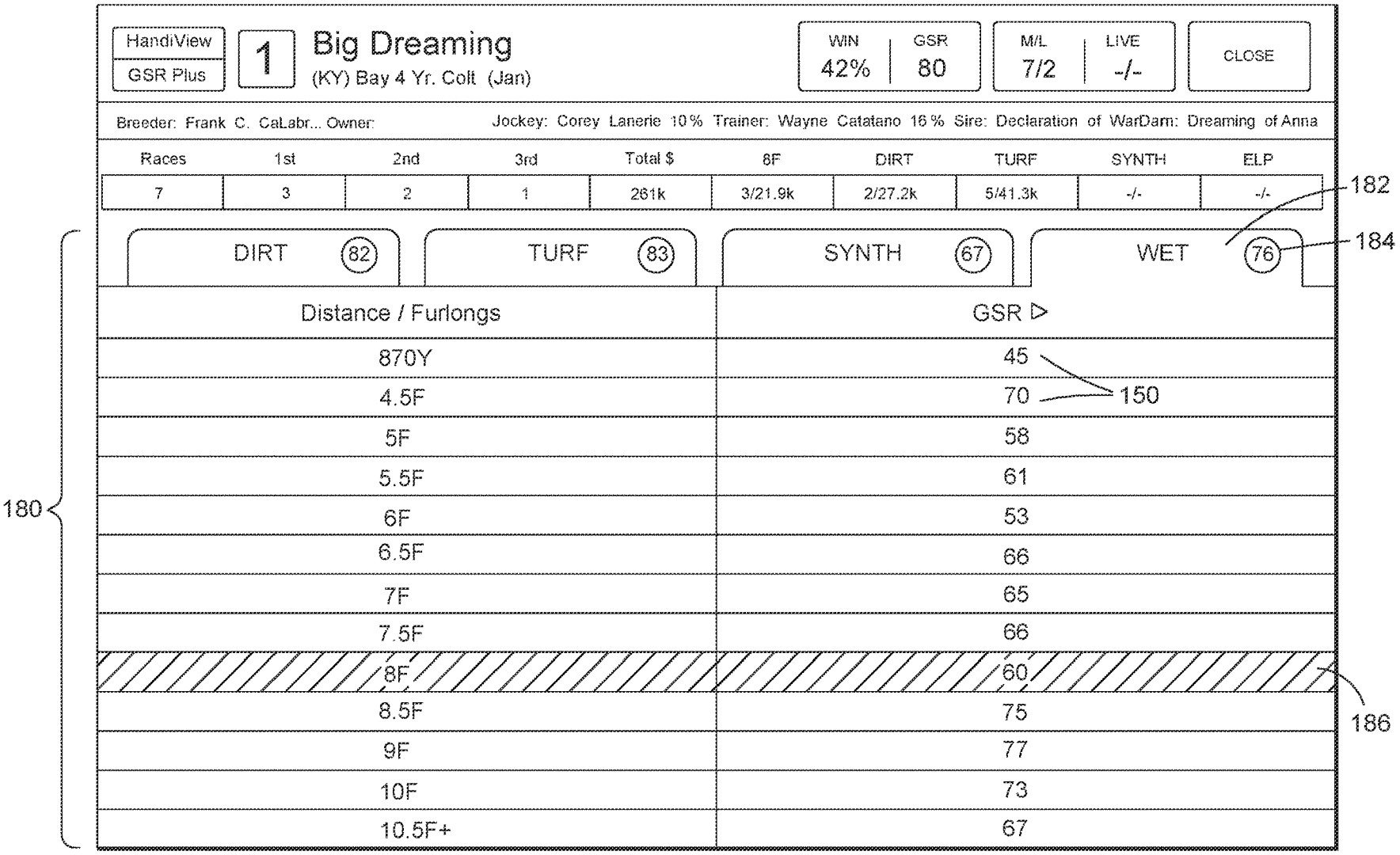
FIG. 7 shows another page of the horse race betting GUI including a detailed view of data associated with the horse.

FIGS. 5-7 show the same grid 180 as it appears in response to the user selecting the other tabs 182, with FIG. 5 showing the state of the horse race betting GUI 100 with the "DIRT" tab 182 selected, FIG. 6 showing the state of the horse race betting GUI 100 with the "SYNTH" tab 182 selected, and FIG. 7 showing the state of the horse race betting GUI 100 with the "WET" tab 182 selected. In each case, the display of ancestry-derived ratings 150 at different distances is updated to show the relevant ratings for the particular track surface (dirt, synthetic, and wet, where wet may refer to dirt and synthetic surfaces under wet conditions, for example). In each instance, the horse race betting GUI 100 may continue to display the highlight 186 to emphasize the rating 150 for the particular distance of the selected race. This way, the user can easily compare ratings 150 for the same distance while tabbing through different track surfaces without losing his or her place.

As shown in FIGS. 4-7, the horse race betting GUI 100 may further display an overall rating 184 for each track surface, which may be presented on each of the tabs 182 corresponding to the respective track surface. In the illustrated example, the overall rating 184 for "Big Dreaming" on turf is "83" (see FIG. 4) while the overall rating 184 for "Big Dreaming" on a dirt surface is "82" (see FIG. 5), the overall rating 184 for "Big Dreaming" on a synthetic surface is "67" (see FIG. 6), and the overall rating 184 for "Big Dreaming" on a wet surface is "76" (see FIG. 7). As described in more detail below, these overall ratings 184 may be ancestry-derived ratings that quantify the expected performance of the horse on the particular track surface irrespective of the distance.

Figure 8:
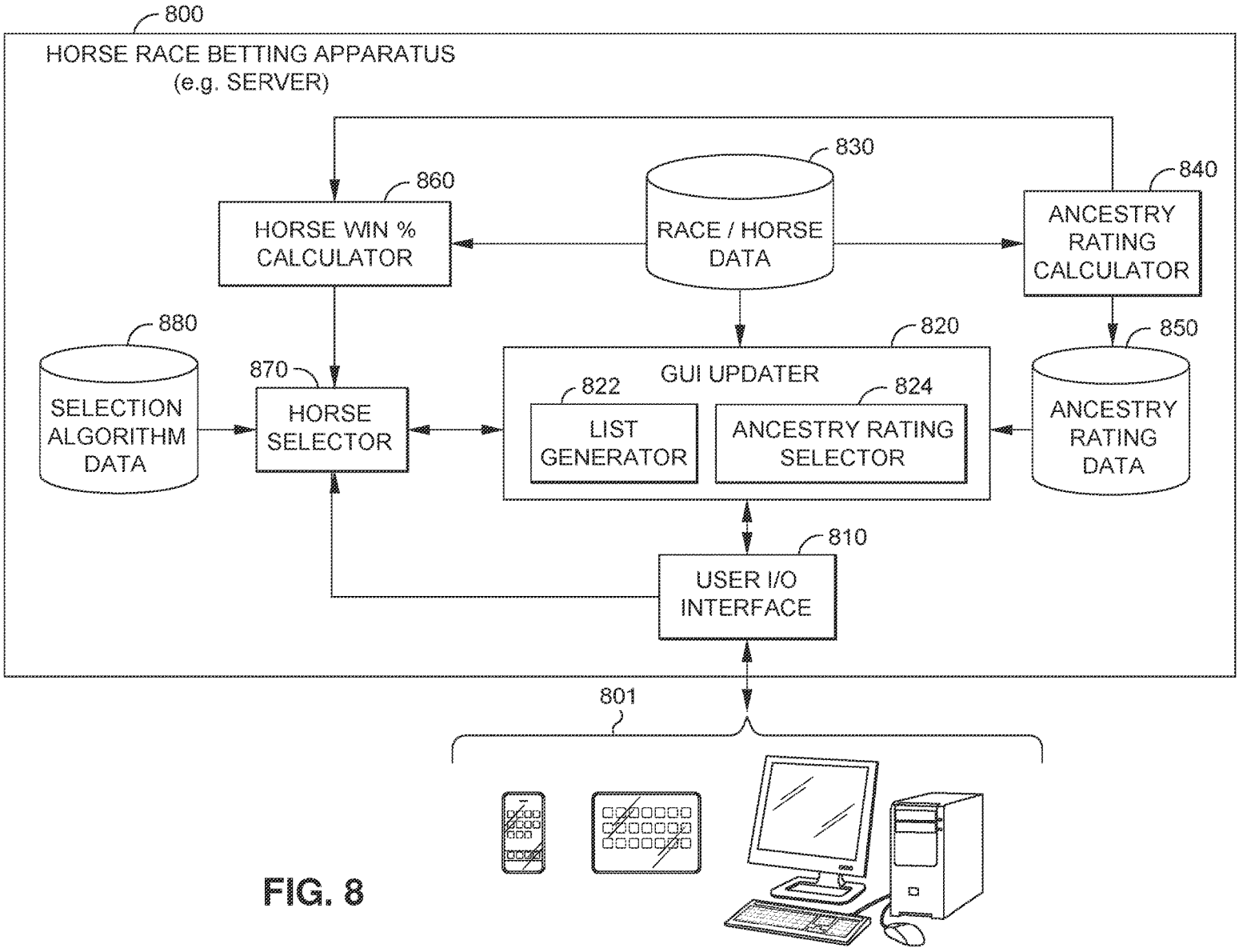
FIG. 8 shows an example horse race betting apparatus according to an embodiment of the present disclosure.

FIG. 8 shows an example horse race betting apparatus 800 according to an embodiment of the present disclosure. The horse race betting apparatus 800 may be a server or a combination of networked servers that interacts with a web browser or mobile application of a user device 801 in order to generate the horse race betting GUI 100 described above. The horse race betting apparatus 800 may include a user I/O interface 810, a GUI updater 820, a race/horse data storage 830, an ancestry rating calculator 840, an ancestry rating data storage 850, a horse win percentage calculator 860, a horse selector 870, and a selection algorithm data storage 880.

The user I/O interface 810 may receive data from and transmit data to a web browser or mobile application of a user device 801. Input data may include, for example, user interaction data of a user with the horse race betting GUI 100, such as selections of date, track, and race, using the selectors 122, 124, 126 of the race selection tool 120, selections of bet type, bet amount, and maximum ticket price and requests for the horse race betting GUI 100 to automatically generate a ticket using the ticket generator 140, manual selections and deselections of horses or other constraints imposed as part of ticket generation, and any data derived from user interaction with links, tabs, buttons, etc. of the horse race betting GUI 100 (e.g. buttons for navigating between pages). Input data may further include data associated with navigation to the page shown in FIG. 1 from a homepage of the horse race betting GUI 100, preference selection related to the horse race betting GUI 100, login information, or other data entered on a previous page of the horse race betting GUI 100, in response to which the horse race betting apparatus 800 may display the elements of the horse race betting GUI 100 described in relation to FIG. 1. Output data of the user I/O interface 810 may include data to be interpreted by a web browser or mobile application in the generation of a functional display in accordance with the horse race betting GUI 100 described herein. In this regard, it should be noted that the terms "displaying," "generating," "listing," "populating," "marking," "updating," etc. as used herein with respect to elements of the horse race betting GUI 100 may include the outputting of data from the user I/O interface 810 or another component of the horse race betting apparatus 800 for use by a user device 801.

Based on the input data received by the user I/O interface 810, the GUI updater 820 may return one or more lists 110 of horses as shown in FIG. 1. For example, the race/horse data storage 830 may store race data from many racetracks, including race schedules, permitted bet types, permitted bet amounts, etc. and any other information to be displayed by the horse race betting GUI 100 (e.g. individual horse statistics of a plurality of horses as may be purchased from a provider of horse racing data such as TrackMaster®). When a user of a user device 801 makes a set of selections using the selectors 122, 124, 126 of the race selection tool 120 of the horse race betting GUI 100, a list generator 822 of the GUI updater 820 may query the race/horse data storage 830 for the race(s) matching the user's selections and return the associated list(s) 110 of horses for display on the user device 801 as shown in FIG. 1. In some cases, as described above, the selectors 122, 124, 126 may be dynamically populated with selectable choices as selections are made. In such cases, the list generator 822 may make a series of queries to the race/horse data storage 830 as the user's selections are made and return intermediate query results (e.g. a list of tracks having races on a selected date, a list of dates on which a selected track has races, etc.) for use in dynamically populating the selectors 122, 124, 126. In view of the fact that horses' statistics change over time, the race and horse data in the race/horse data storage 830 may be continually updated, e.g., over a network such as the Internet.

The ancestry rating calculator 840 may calculate the ancestry-derived ratings 150 of the horses whose data is stored in the race/horse data storage 830. As noted above, the particular ratings 150 to be displayed by the horse race betting GUI 100 may advantageously be specific not only to the horse in question but to the particular attributes of a race selected by a user, including track surface and distance. To this end, the race/horse data storage 830 may index ancestry data by these and/or other various race attributes, and the ancestry rating calculator 840 may calculate, for each horse, different ratings 150 based on respective subsets of the ancestry data. For example, in order to calculate an 8-furlong turf rating 150 for a horse, the ancestry rating calculator 840 may derive the rating 150 from 8-furlong turf performance data of the horse's family, giving less weight to or discounting performance data on other distances and track surfaces. If insufficient data exists for the horse with respect to the horse's family's performance on a given track surface and distance, the ancestry rating calculator 840 may derive no rating 150 for those particular parameters, and the horse race betting GUI 100 may display no rating 150 in the event that a race having those parameters is selected by the user.

The ratings 150 may quantify an expected performance of a given horse for different combinations of track surface and distance and may be calculated according to any algorithm (e.g. machine learning algorithms) on the basis of publicly available information, with relevant data being obtained from a provider of horse racing data such as TrackMaster® and stored in the race/horse data storage 830 as described above. Based on such data, the ancestry rating calculator 840 may calculate each rating 150 from any combination of various data features (e.g. track records of the horse's ancestors on the particular surface and distance), which may be derived from ancestry data associated with a sire and/or a dam of the horse in question, for example. It is contemplated that the ancestry data may go back three or more generations and may include cousins and siblings on both the sire and dam side, e.g., mother, mother's mother, mother's mother's children, mother's mother's children's children, etc. As between two sibling horses, where the performance of each horse might affect the rating of the other, it may be desirable for each horse's performance to equally affect the horse itself in order to avoid a distorted effect (where a horse's good performance improves family member's ratings 150 but not the horse's own). Thus, the ratings 150 derived for each horse may be derived at least in part from the performance data of the horse itself. In this way, as a horse's performance improves over its life, the ratings 150 of the horse's entire family including itself may improve accordingly.

The ancestry rating calculator 840 may input such data features into an algorithm whose output is the particular rating 150, which may be specific for a particular distance and/or track surface as described above. (In the case of deriving the overall ratings 184 for each track surface as shown in FIGS. 4-7, the data features used may be track surface-specific but not distance-specific.) As one example of calculating a rating 150, past race data can be used to process past horses into arrays of data features (e.g. evaluated to −1, 0, and 1 or any floating point numbers), and the race results can be used to train a Support Vector Machine (SVM) or Neural Network (NN) to output a predictive ancestry-derived performance rating 150 based on the data features. The SVM or NN can then be used to predict future performance and generate the ratings 150 based on the same data features as applied to future races. In order to be easily understandable by a user of the horse race betting GUI 100, the ratings 150 may be two-digit numbers as shown in the illustrated examples, which may be stored in the ancestry rating data storage 850. The ancestry rating calculator 840 may further provide the ratings 150 to the horse win percentage calculator 860 and/or the horse selector 870 for use in the automatic selection of horses by the horse race betting apparatus 800.

For each horse from among the list of horses 110 (see FIGS. 1 and 2), which may be displayed on the basis of the user's interaction with the race selection tool 120 as described above, an ancestry rating selector 824 of the GUI updater 820 may select a rating corresponding to the horse, the track surface of the selected race, and the distance of the selected race. For example, as shown in FIG. 2, the particular rating 150 that is selected for "Big Dreaming" from the ancestry rating data storage 850 may be "80," which is the rating 150 corresponding to 8-furlong turf races. The GUI updater 820 may display the selected ratings 150 in association with the horses in the list 110. As the user navigates to pages of the horse race betting GUI 100 where more detailed information is shown about a given horse (e.g. FIGS. 3-7), the GUI updater 820 may likewise display additional ratings 150 selected by the ancestry rating selector 824 corresponding to various combinations of track surface and distance as described above.

Like the horse win percent calculator 240 described in the '310 patent, the horse win percentage calculator 860 of the present application may calculate predicted win percentages of the horses in each of a plurality of scheduled races. The predicted win percentage of a horse, which may be displayed in the "Win" column shown in FIG. 1, for example, may represent the likelihood that the horse will win a given race as determined according to any algorithm (e.g. machine learning algorithms) on the basis of publicly available information. For example, relevant data may be obtained from a provider of horse racing data such as TrackMaster® and stored in the race/horse data storage 830. Based on such data, the horse win percentage calculator 860 may input any combination of various data features (e.g. age of horse, horse's track record, jockey's track record, trainer's track record, etc.) into an algorithm whose output is the predicted win percentage. For example, past race data can be used to process past horses into arrays of data features (e.g. evaluated to −1, 0, and 1 or any floating point numbers), and the race results can be used to train a Support Vector Machine (SVM) or Neural Network (NN) to predict horse finish order based on the data features. The SVM or NN can then be used to predict future horse finish order and generate predicted win percentages based on the same data features as applied to future races. A corresponding predicted win percentage may thus be provided to the GUI updater 820 for each horse in the list 110 generated by the list generator 822, such that the predicted win percentages may be displayed on the horse race betting GUI 100 as shown in FIG. 1 ("Win" column). The horse win percentage calculator 860 may further provide the predicted win percentages to the horse selector 870 for use in the automatic selection of horses by the horse race betting apparatus 800.

The horse selector 870 may determine an optimal selection of horses in response to the user's interaction with the ticket generator 140 (e.g. an automatic ticket generation button 142 thereof). For example, upon receiving a command to perform automatic ticket generation from the user I/O interface 801, the horse selector 870 may select one or more horses in accordance with a selection algorithm stored in the selection algorithm data storage 880. To this end, the horse selector 870 may receive, as inputs to the selection algorithm, the predicted win percentages calculated for each horse of the list 110 (or plural lists 110 in the case of horizontal betting) generated by the list generator 822, along with various constraints (e.g. bet amount, maximum ticket price, manually selected/locked horses and legs, etc.). The horse selector 870 may then select one or more horses so as to maximize a function of the predicted ticket win percentage without causing a number of bets times the bet amount to exceed the maximum ticket price and within any constraints imposed by the user. In the simplest case, the horse selector 870 may maximize the predicted ticket win percentage itself. However, a user may in some cases be better served by maximizing a function of predicted ticket win percentage and ticket cost, for instance, and/or taking into consideration an expected payout, morning line odds, live odds, etc., as described in the '310 patent. The horse race betting apparatus 800 may include various selection algorithms in the selection algorithm data storage 880, and the horse race betting GUI 100 may allow the user to choose a preferred algorithm from an options menu.

With the ancestry-derived ratings 150 having been calculated by the ancestry rating calculator 840 and stored in the ancestry rating data storage 850 as described above, it is contemplated that the automatic selection of horses may further be based on the selected ratings 150 for the race in question (as may be communicated to the horse selector 870 by the GUI updater 820 along with the various user-imposed constraints). For example, the selection algorithm may maximize a function of both the predicted win percentage and the selected rating 150 for each horse. Alternatively, the rating 150 calculated by the ancestry rating calculator 840 may be factored in earlier as part of the calculation of the predicted win percentage. That is, the predicted win percentage for each horse in the selected race may be based in part on the ancestry-derived ratings 150 calculated by the ancestry rating calculator 840 for that horse. Advantageously, the horse win percentage calculator 860 may calculate different predicted win percentages for each horse based on the different ratings 150 corresponding to each track surface and distance, resulting in highly targeted predicted win percentages. In this case, the horse selector 870 may select and use the predicted win percentage that corresponds to the track surface and distance of the selected race. The same race-specific predicted win percentage may be displayed to the user on the horse race betting GUI 100.

The GUI updater 820 may update the horse race betting GUI 100 to reflect the automatic selections made by the horse selector 870. For example, the GUI updater 820 may update the display to indicate that the automatically selected horses are marked (e.g. displaying a checkmark with respect to a corresponding horse win selection element as described in the '310 patent, which may be displayed corresponding to each horse in the list 110 or in a separate ticket view accessible upon clicking the automatic ticket generation button 142, for example). Based on the predicted win percentages calculated by the horse win calculator 860 and/or the ancestry ratings 150 calculated by the ancestry rating calculator 840, the GUI updater 820 may further recalculate and display an updated predicted ticket win percentage, ticket cost, etc. When the user is satisfied with the selection of horses, the user may wish to finalize the ticket. Features supporting the finalization of a ticket may include, for example, an option to print the ticket, save the ticket locally or on a remote server, submit/purchase the ticket (e.g. via a link to a third-party website or a third-party API providing direct bet placement functionality), etc. The horse race betting apparatus 800 may further store records of such finalized tickets, which may be used to generate betting statistics/feedback associated with the particular user.

As described above, the user I/O interface 810 may output data to be interpreted by a web browser or mobile application in the generation of a functional display in accordance with the horse race betting GUI 100 described herein. Such data may include data that is output, updated, or managed by the GUI updater 820, such as data for displaying one or more lists 110, including predicted win percentages and ancestry-derived ratings 150, as well as horse selections (whether manually or automatically determined), user-imposed constraints for generating a ticket, a predicted ticket win percentage, and a ticket cost, and any other information about the horses in the list 110 such as morning line (M/L) odds, live odds, etc. Data output by the user I/O interface 810 may also include various data for displaying other static and dynamic elements of the horse race betting GUI 100, including, for example, the selectors 122, 124, 126 of the race selection tool 120, the automatic ticket generation button 190 and other functional elements of the ticket generator 140, etc. By communicating such data to a web browser or mobile application of a user device 801 (e.g. over a network such as the Internet), the horse race betting apparatus 800 may be regarded as displaying, generating, listing, populating, marking, updating, etc. the various elements of the horse race betting GUI 100.

FIG. 9 shows an example data structure of ancestry rating data referred to by the horse race betting apparatus 800. The data structure shown in FIG. 9 may represent the contents of the ancestry rating data storage 850, namely a plurality of ancestry-derived ratings 150 calculated by the ancestry rating calculator 840 for each horse as described above. In the example of FIG. 9, the data structure is illustrated in tabular form to represent how the ratings 150 may be organized and/or indexed. In particular, for each of a plurality of horses ("HORSE 1," "BIG DREAMING," "HORSE 2," "HORSE 3," etc.), an array of ratings 150 is illustrated (visible only for "BIG DREAMING"), with each cell corresponding to a specific track surface ("DIRT," "TURF," "SYNTH," "WET") and a specific distance ("870Y," "4.5F," "5F," etc.). From among this data, the ancestry rating selector 824 of the GUI updater 820 may select an appropriate rating 150 or ratings 150 for display based on the particular race and/or horse selected by a user of the horse race betting GUI 100 as described above in relation to FIGS. 1-7.

Figure 10:
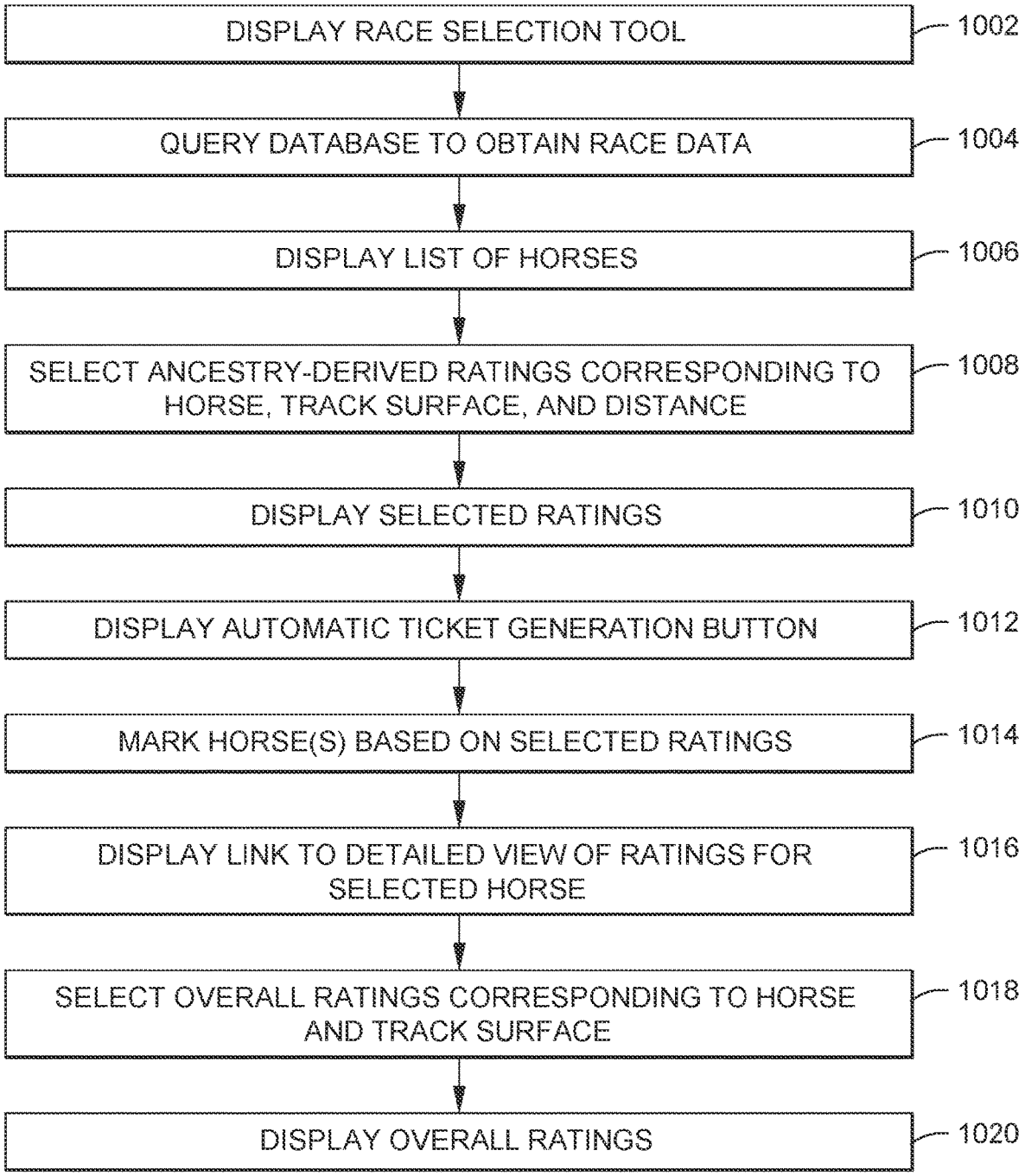
FIG. 10 shows an example operational flow for generating the horse race betting GUI.

FIG. 10 shows an example operational flow according to an embodiment of the present disclosure. Referring by way of example to the horse race betting GUI 100 shown in FIGS. 1-7 and the horse race betting apparatus 800 shown in FIG. 8, the horse race betting apparatus 800 may present the horse race betting GUI 100 to a user of a user device 801 (e.g. smartphone, tablet, personal computer, etc.) via a web interface or mobile application, for example. In particular, the horse race betting apparatus 800 may display a race selection tool 120 by which a user of the horse race betting GUI 100 may select a horserace (step 1002). The race selection tool 120 may include a date selector 122, track selector 124, and race selector 126 as shown in FIG. 1, for example. In response to a user interaction with the race selection tool 120, the horse race betting apparatus 800 may query the race/horse data storage 830 to obtain race data associated with the selected race (step 1004) and display a list 110 of horses based on the obtained race data (step 1006). For each horse from among the list 110 of horses, the horse race betting apparatus 800 may, at the same time, select an ancestry-derived rating 150 corresponding to the horse, the track surface of the selected race, and the distance of the selected race (step 1008). Each such rating 150 may be selected from a plurality of ratings 150 stored in the ancestry rating data storage 850 (see FIG. 9). As described above, the ratings 150 may have previously been calculated by an ancestry rating calculator 840 of the horse race betting apparatus 800 and stored in the ancestry rating data storage 850 for use in generating the horse race betting GUI 100. The horse race betting apparatus 800 may display the selected ratings 150 in association with the horses (step 1010). The selected ratings 150 may be displayed in association with each respective horse in the list 110 as shown in FIG. 2, for example (see "GSR" column of "GSR" tab), along with other statistics of the horse pertaining to its performance on the particular track surface and distance of the selected race (8-furlong turf). The selected ratings 150 may also be displayed as part of a detailed view of data associated with a particular horse as described above in relation to FIGS. 3-7.

Additionally, and typically simultaneously, the horse race betting apparatus 800 may display an automatic ticket generation button 142 by which the user may request an automatic selection of horses to generate a horse race betting ticket (step 1012). The automatic ticket generation button 142 may be part of a "Ticket-Gen" tab as shown in FIG. 1, for example. In response to a user interaction with the automatic ticket generation button 142, the horse race betting apparatus 800 (e.g. a horse selector 870 thereof) may mark one or more horses as selected to win the race (step 1014). The automatic selection of horses may be in part based on the selected ancestry-derived ratings 150 as described above, either taking the selected ratings 150 into account in combination with the predicted win percentages or, alternatively, by using race-specific predicted win percentage that incorporate the selected ratings 150.

As noted above, the selected ratings 150 may be displayed as part of a detailed view of data associated with a particular horse as described above in relation to FIGS. 3-7. In this regard, the operational flow of FIG. 10 may further include, typically simultaneously, displaying a link to a detailed view of data associated with one of the horses (step 1016). The link may be accessed, for example, by clicking or tapping one of the horse's names in the list 110 of horses, followed by clicking or tapping the button 170 (see FIG. 3). The detailed view may include the entire plurality of ratings 150 for the horse stored in the ancestry rating data storage 850 (e.g. for all track surfaces and distances for which sufficient data is available to generate a rating 150), which may be organized in a grid 180 as described in relation to FIGS. 4-7. As an additional tool to assist the user of the horse race betting GUI 100, the horse race betting apparatus 800 may further select an overall rating 184 of the horse for each track surface, irrespective of distance (step 1018). The overall ratings 184 may be displayed on the tabs 182 corresponding to each track surface as shown in FIGS. 4-7 (step 1020).

It should be noted that the ordering of steps 1002-1020 may vary depending on the details of how the horse race betting GUI 100 is implemented as well as how the horse race betting GUI 100 is interacted with by a user, and it may be possible for some of the steps to be performed simultaneously. The steps may also be preceded by any number of steps associated with login, preference selection, navigation, etc., which may occur prior to the arrival of the user at the page of the horse race betting GUI 100 shown in FIG. 1, for example.

In the above examples, horse race betting ticket(s) may be generated in part based on predicted win percentages of each horse running the race. In this regard, various other features of horses (including features of the horses' trainers, jockeys, etc.) may be used in place of predicted win percentages throughout the disclosure including, for example, expected payout, return on investment (ROI), or any other feature that may be determined from available data associated with the horses, whether it is determined automatically based on an algorithm or manually by experts.

Figure 11:
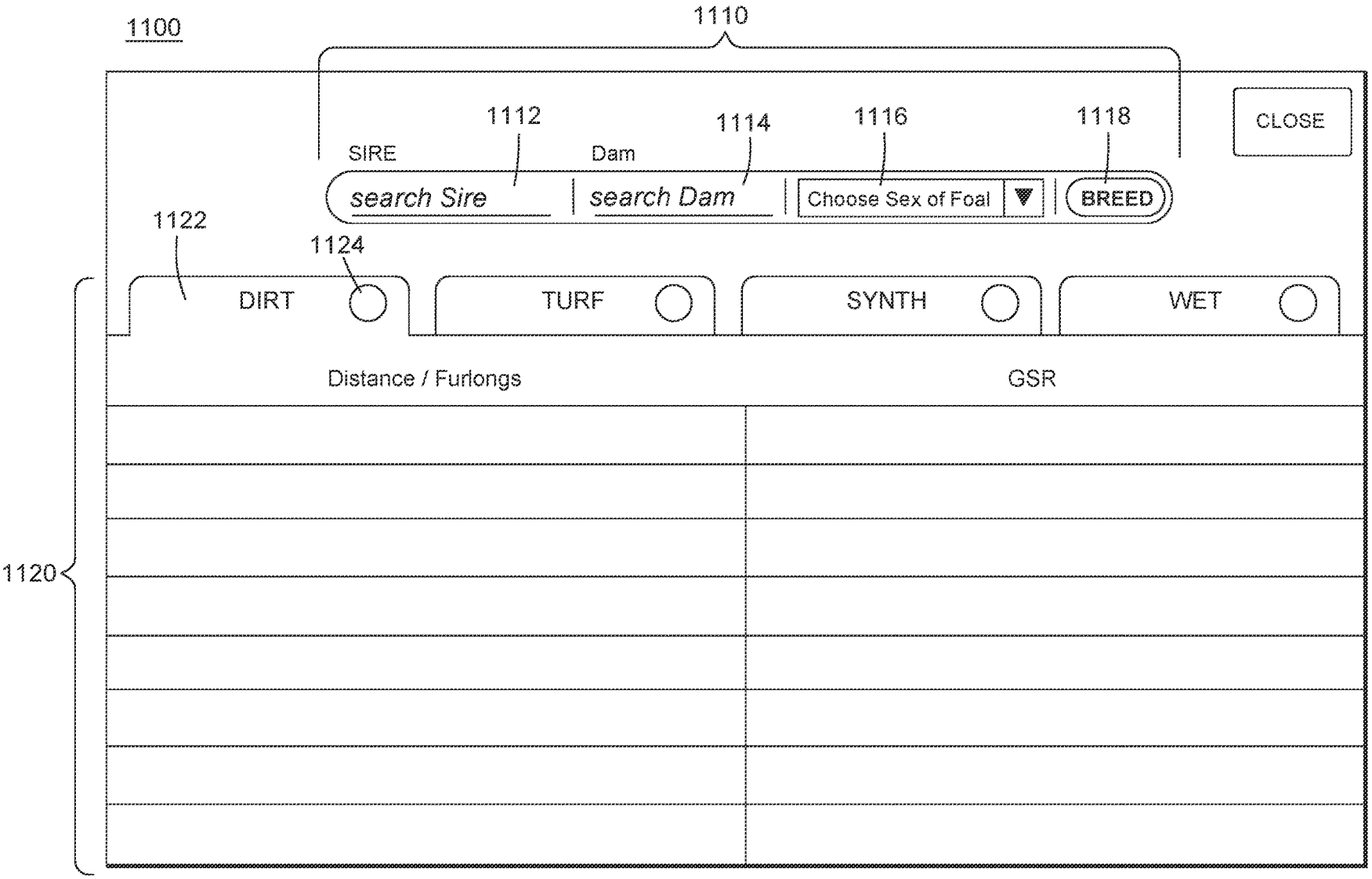
FIG. 11 shows an example view of a horse breeding GUI according to another embodiment of the present disclosure.

FIG. 11 shows an example view of a horse breeding GUI 1100 according to another embodiment of the present disclosure. Like the horse race betting GUI 100, the horse breeding GUI 1100 may present a user with ancestry-derived ratings of horses that are specifically targeted to the needs of the user. However, whereas the horse race betting GUI 100 may be aimed at a user who is interested in generating a horse race betting ticket, the horse breeding GUI 1100 may instead serve the different needs of a horse breeder. In particular, rather than automatically selecting ancestry-derived ratings specific to a scheduled race, the horse breeding GUI 1100 may derive ratings for an unborn foal based on a potential pairing of sire and dam. Thus, unlike conventional systems that provide raw pedigree information, for example, the horse breeding GUI 1100 may serve as a tool for assisting breeders and other users with making decisions based on the most relevant ancestry-derived ratings for the user's purpose.

In some respects, the horse breeding GUI 1100 shown in FIG. 11 may be similar in appearance to the pages of the horse race betting GUI 100 shown in FIGS. 4-7. In particular, just like the grid 180, the horse breeding GUI 1100 may feature a grid 1120 or other organizational tool for displaying ancestry-derived ratings ("GSR" column) in relation to corresponding track surfaces ("DIRT," "TURF," "SYNTH," "WET") and distances ("Distance/Furlongs"). In FIG. 11, the grid 1120 is shown in an unpopulated state as the user has not yet entered any information. In this regard, the horse breeding GUI 1100 may include a breeding selection tool 1110 by which a user may select a sire and a dam to be paired in a hypothetical breeding. For example, the user may enter a first horse's name or other identifier in a sire selector 1112, enter a second horse's name or other identifier in a dam selector 1114, and click or tap a breed button 1118. When the user clicks or taps the breed button 1118, the horse breeding GUI 1100 may populate the grid 1120 with a plurality of ancestry-derived ratings that are derived based on the hypothetical pairing of sire and dam. The ratings may quantify an expected race performance of the foal for different combinations of track surface and distance as may be separately displayable in the grid 1120 or other organizational tool, allowing the user to easily review the expected ratings for such a foal and evaluate the value of the hypothetical pairing for specific types of races (e.g. track surface and distance).

The sire selector 1112 and the dam selector 1114 may be search fields as shown, where the user may begin typing the name of a horse and be presented with a dynamically generated list of sires or dams matching the partial name typed in by the user. In this way, the user may type the first letter or first few letters of the name and then select the horse from a list (e.g. by mouse click). Where multiple horses have the same name, the horse breeding GUI 1100 may distinguish the horses by further identifying information, such as the name of the horse's dam, for example.

Unlike in the case of the horse race betting GUI 100, the hypothetical foal whose ancestry-derived ratings will be displayed on the horse breeding GUI 1100 is not necessarily born (though in some cases the foal will be born but not yet racing, for example). Therefore, in implementations where the derivation of the ancestry-derived ratings may depend on the sex of the foal, this information may need to be entered into the horse breeding GUI 1100. To this end, it is contemplated that the breeding selection tool 1100 may include a sex selector 1116. The sex selector 1116 may be in the form of a drop-down menu as shown or may take other forms (e.g. radio buttons), allowing the user to choose between "male" and "female" in addition to inputting the sire and dam prior to pressing the breed button 1118.

The plurality of ratings displayed in response to the user interaction with the breeding selection tool 1110 may be organized in a grid 1120 as shown, having a first dimension (e.g. rows) and a second dimension (e.g. columns) corresponding to distance and track surface, respectively. In order to make the most efficient use of screen real estate (especially in the case of displaying the horse breeding GUI 1100 on a mobile device having a small screen such as a smartphone), one of the two dimensions may be displayed in separate tabs 1122 selectable by the user. Because there are fewer possible track surfaces than distances, the dimension that is displayed in separate tabs 1122 is preferably the second dimension, i.e. the one corresponding to the different track surfaces. In the specific example shown in FIG. 11, the first dimension of the grid 1120 is rows and the second dimension is columns, such that the tabs 1122 are displayed along the top of the grid 1120. However, it is contemplated that the first dimension may be columns while the second is rows, in which case the tabs 1122 may be displayed along the left side of the grid 1120, for example.

Like the grid 180 of the horse race betting GUI 100, the rows of the grid 1120 may display a series of distances ranging from 870 yards up to 10.5 furlongs, with the horse's ancestry-derived ratings shown for each distance on that particular track surface. In response to the user selecting different tabs 1122, the ratings for each track surface (dirt, turf, synthetic, wet) may be displayed. Also like the horse race betting GUI 100, the horse breeding GUI 1100 may further display an overall rating 1124 for each track surface, which may be presented on each of the tabs 1122 corresponding to the respective track surface. These overall ratings 1124 may be ancestry-derived ratings that quantify the expected performance of the hypothetical foal on the particular track surface irrespective of the distance.

Figure 12:
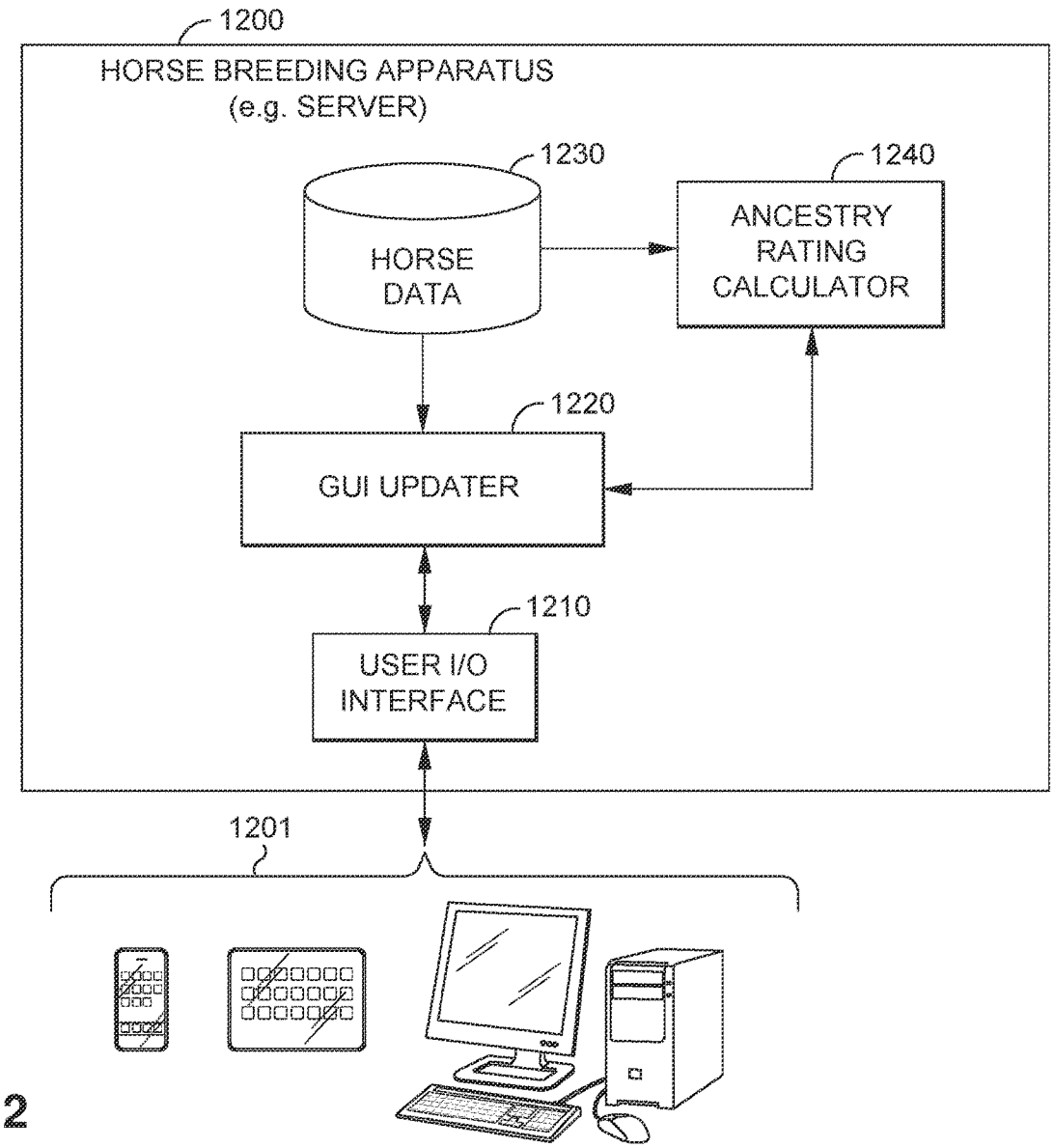
FIG. 12 shows an example horse breeding apparatus according to an embodiment of the present disclosure.

FIG. 12 shows an example horse breeding apparatus 1200 according to an embodiment of the present disclosure. The horse breeding apparatus 1200 may be a server or a combination of networked servers that interacts with a web browser or mobile application of a user device 1201 in order to generate the horse breeding GUI 1100 described above. The horse breeding apparatus 1200 may include a user I/O interface 1210, a GUI updater 1220, a horse data storage 1230, and an ancestry rating calculator 1240.

The user I/O interface 1210 may receive data from and transmit data to a web browser or mobile application of a user device 1201. Input data may include, for example, user interaction data of a user with the horse breeding GUI 1100, such as selections of sire, dam, and sex of foal using the sire selector 1112, dam selector 1114, and sex selector 1116 of the breeding selection tool 1110, requests for the horse breeding GUI 1100 to generate and display ancestry-derived ratings for a hypothetical foal using the breed button 1118 of the breeding selection tool 1110, and any data derived from user interaction with links, tabs, buttons, etc. of the horse breeding GUI 1100 (e.g. buttons for navigating between pages). Input data may further include data associated with navigation to the page shown in FIG. 11 from a homepage of the horse breeding GUI 1100 (which may be the same or separate from that of the horse race betting GUI 100), preference selection related to the horse breeding GUI 1100, login information, or other data entered on a previous page of the horse breeding GUI 1100, in response to which the horse breeding apparatus 1200 may display the elements of the horse breeding GUI 1100 described in relation to FIG. 11. Output data of the user I/O interface 1210 may include data to be interpreted by a web browser or mobile application in the generation of a functional display in accordance with the horse breeding GUI 1100 described herein. In this regard, it should be noted that the terms "displaying," "generating," "listing," "populating," "marking," "updating," etc. as used herein with respect to elements of the horse breeding GUI 1100 may include the outputting of data from the user I/O interface 1210 or another component of the horse breeding apparatus 1200 for use by a user device 1201.

Based on the input data received by the user I/O interface 1210, the GUI updater 1220 may return names of horses to implement the dynamic search described in relation to the sire selector 1112 and dam selector 1114 shown in FIG. 11. For example, the horse data storage 1230 may store individual horse names and statistics of a plurality of horses as may be purchased from a provider of horse racing data such as TrackMaster®. In order to dynamically populate the sire and dam selectors 1112, 1114 with selectable choices as selections are made, the GUI updater 1220 may make a series of queries to the horse data storage 1230 as the user begins to input the desired horse names and return intermediate query results in the form of a list of horse names matching the partial input. In view of the fact that horses' statistics change over time and new horses reach racing age, the data in the horse data storage 1230 may be continually updated, e.g., over a network such as the Internet.

With the selection of a sire and a dam (and in some cases a sex of the hypothetical foal) having been received by the GUI updater 1220, the GUI updater 1220 may further populate the grid 1120 with ancestry-derived ratings of the hypothetical foal. To this end, the ancestry rating calculator 1240 may receive the input data including the user's sections from the GUI updater 1220 and calculate ancestry-derived ratings for the hypothetical foal based on the data stored in the horse data storage 1230. As noted above, the particular ratings to be displayed by the horse breeding GUI 1100 may advantageously be specific not only to the foal in question but to specific racetrack attributes, including track surface and distance. To this end, the horse data storage 1230 may index ancestry data by these and/or other various race attributes, and the ancestry rating calculator 1240 may derive, for the hypothetical foal, a plurality of different ratings based on respective subsets of the ancestry data. For example, in order to calculate an 8-furlong turf rating for an unborn foal, the ancestry rating calculator 1240 may derive the rating from 8-furlong turf performance data of the unborn foal's family, giving less weight to or discounting performance data on other distances and track surfaces. If insufficient data exists for the foal with respect to its family's performance on a given track surface and distance, the ancestry rating calculator 1240 may derive no rating for those particular parameters, and the horse breeding GUI 1100 may display no rating in the corresponding portion of the grid 1120.

The ratings may quantify an expected performance of the foal for different combinations of track surface and distance and may be calculated according to any algorithm (e.g. machine learning algorithms) on the basis of publicly available information, with relevant data being obtained from a provider of horse racing data such as TrackMaster® and stored in the horse data storage 1230 as described above. Based on such data, the ancestry rating calculator 1240 may calculate each rating from any combination of various data features (e.g. track records of the hypothetical foal's family on the particular surface and distance), which may be derived from ancestry data associated with the selected sire and dam, for example. It is contemplated that the ancestry data may go back two or more generations relative to the sire and dam (i.e. three or more generations relative to the hypothetical foal) and may include cousins and siblings on both the sire and dam side, e.g., mother, mother's mother, mother's mother's children, mother's mother's children's children, etc. In some implementations, the calculation of the ratings may be further dependent on the sex of the unborn foal, which may be selected by the user using the sex selector 1116 as described above and thus taken into account by the ancestry rating calculator 1240.

The ancestry rating calculator 1240 may input such data features into an algorithm whose output is the derived rating, which may be specific for a particular distance and/or track surface as described above. (In the case of deriving the overall ratings 1124 for each track surface as shown in FIG. 11, the data features used may be track surface-specific but not distance-specific.) As described above in relation to the horse race betting apparatus 100, as one example of calculating a rating, past race data can be used to process past horses into arrays of data features (e.g. evaluated to −1, 0, and 1 or any floating point numbers), and the race results can be used to train a Support Vector Machine (SVM) or Neural Network (NN) to output a predictive ancestry-derived performance rating based on the data features. The SVM or NN can then be used to predict future performance and generate the ratings based on the same data features as applied to future races. In order to be easily understandable by a user of the horse breeding GUI 1100, the ratings may be two-digit numbers as shown in FIG. 11.

As described above, the user I/O interface 1210 may output data to be interpreted by a web browser or mobile application in the generation of a functional display in accordance with the horse breeding GUI 1100 described herein. Such data may include data that is output, updated, or managed by the GUI updater 1220, such as data for displaying ancestry-derived ratings in the grid 1120. Data output by the user I/O interface 1210 may also include various data for displaying other static and dynamic elements of the horse breeding GUI 1100, including, for example, the selectors 1112, 1114, 1116 and breed button 1118 of the breeding selection tool 1110. By communicating such data to a web browser or mobile application of a user device 1201 (e.g. over a network such as the Internet), the horse breeding apparatus 1200 may be regarded as displaying, generating, listing, populating, marking, updating, etc. the various elements of the horse breeding GUI 1100.

Figure 13:
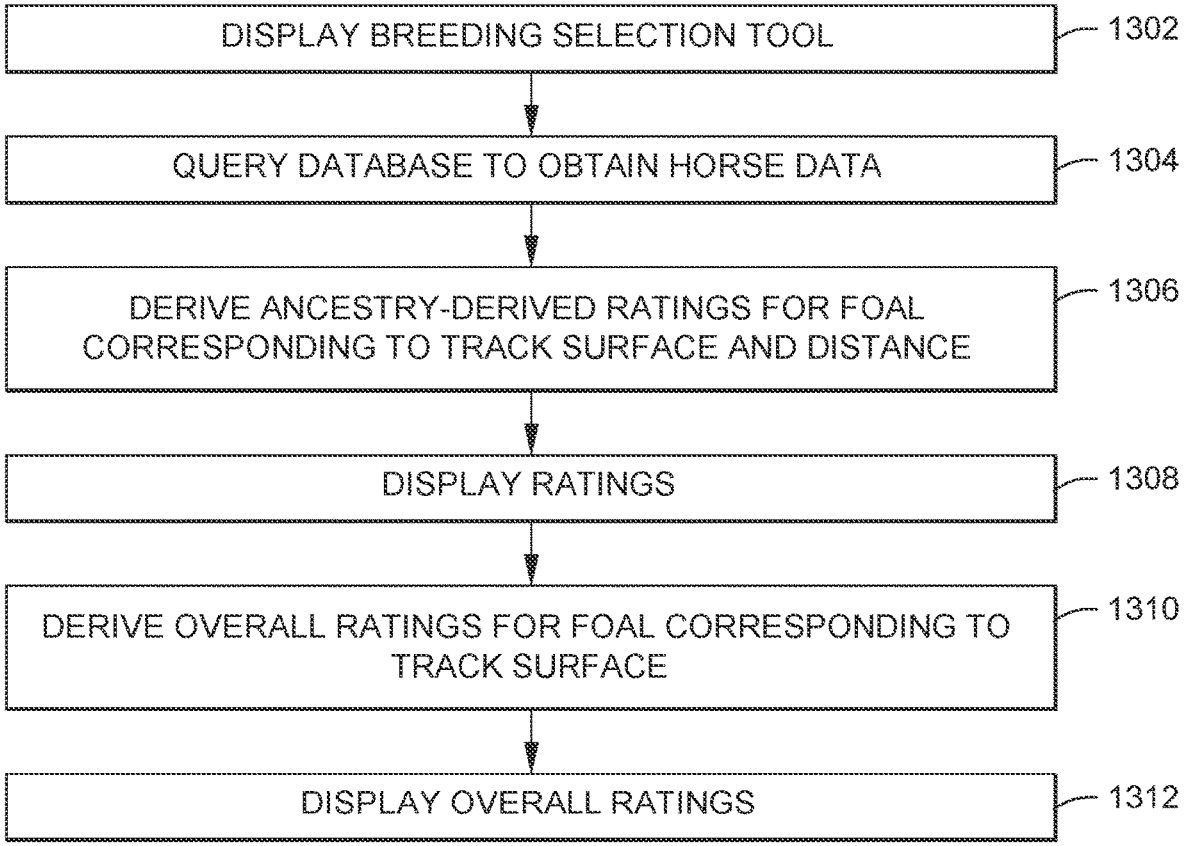
FIG. 13 shows an example operational flow for generating the horse breeding GUI.

FIG. 13 shows an example operational flow according to an embodiment of the present disclosure. Referring by way of example to the horse breeding GUI 1100 shown in FIG. 11 and the horse breeding apparatus 1200 shown in FIG. 12, the horse breeding apparatus 1200 may present the horse breeding GUI 1100 to a user of a user device 1101 (e.g. smartphone, tablet, personal computer, etc.) via a web interface or mobile application, for example. In particular, the horse breeding apparatus 1100 may display a breeding selection tool 1110 by which a user of the horse breeding GUI 1100 may select a sire and a dam, as well as optionally a sex of the hypothetical foal (step 1302). The breeding selection tool 1110 may include a sire selector 1112, dam selector 1114, sex selector 1116, and breed button 1118 as shown in FIG. 11, for example. As the user manipulates the breeding selection tool 1110, the horse breeding apparatus 1200 may query the horse data storage 1230 to obtain horse's names in order to implement dynamic search features of the sire and dam selectors 1112, 1114 (step 1304). In response to a user interaction with the breeding selection tool 1110 to request a hypothetical pairing of a sire and dam (e.g. by clicking the breed button 1118), the horse breeding apparatus 1200 may derive a plurality of ancestry-derived ratings from data associated with the selected sire and data associated with the selected dam, as may be stored in the horse data storage 1230 (step 1306), which may in some cases depend on the sex of the hypothetical foal. The derived ratings may quantify an expected race performance for a foal of the sire and dam for different combinations of track surface and distance. The horse breeding apparatus 1200 may display the derived ratings on the horse breeding GUI 1100 organized according to track surface and distance, for example, in a grid 1120 as shown in FIG. 11 (step 1308). As an additional tool to assist the user of the horse breeding GUI 1100, the horse breeding apparatus 1200 may further derive an overall rating 1124 of the hypothetical foal for each track surface, irrespective of distance (step 1310). The overall ratings 1124 may be displayed on the tabs 1122 corresponding to each track surface as shown in FIG. 11 (step 1312).

It should be noted that the ordering of steps 1302-1312 may vary depending on the details of how the horse breeding GUI 1100 is implemented as well as how the horse breeding GUI 1100 is interacted with by a user, and it may be possible for some of the steps to be performed simultaneously. The steps may also be preceded by any number of steps associated with login, preference selection, navigation, etc., which may occur prior to the arrival of the user at the page of the horse breeding GUI 1100 shown in FIG. 11, for example.

Throughout the above description of the horse race betting GUI 100 and horse breeding GUI 1100, reference is made to various means of user interaction, including clicking on various user interface elements. The disclosure is not intended to be limited to such specific interactions and any known user-device interactions may be applicable, including but not limited to keyboard, mouse, touch, gesture, voice, eye-tracking, etc. The various selectors, selectable elements, navigators, and buttons described in relation to FIGS. 1-7 and 11 may be any kind of graphical user interface element that fulfills the described functions, for example, drop-down menus, list boxes, etc. for selection from a list (or alternatively blank input fields), and checkboxes, radio buttons, switches, etc. for elements to be marked, switched, toggled, etc.

Owing to the various combinations of features described throughout this disclosure, the disclosed horse race betting GUI 100, horse race betting apparatus 800, horse breeding GUI 1100, horse breeding apparatus 1200, and related embodiments may be regarded as an improvement to conventional computer-implemented systems for providing pedigree and other ancestry-derived information to a user. Such conventional tools merely provide raw data about a horse, only adding the convenience of computer technology to the otherwise conventional paper-and-pencil process of manually researching a horse's published information. In contrast, the disclosed embodiments represent an entirely unconventional approach to horse race betting and ticket generation by providing a graphical user interface that allows a user to access targeted ancestry-derived ratings for a horse that are specific to the conditions of a particular scheduled race, such as track surface and distance. The graphical user interface may also automatically generate one or more optimal tickets taking into account these particular targeted ratings for the horses running the race. The disclosed embodiments represent a similarly unconventional approach to horse breeding by providing a graphical user interface that allows a user to create a hypothetical pairing between a sire and a dam and calculates a plurality of ancestry-derived ratings for the unborn foal that are specific to race conditions such as track surface and distance.

Figure 14:
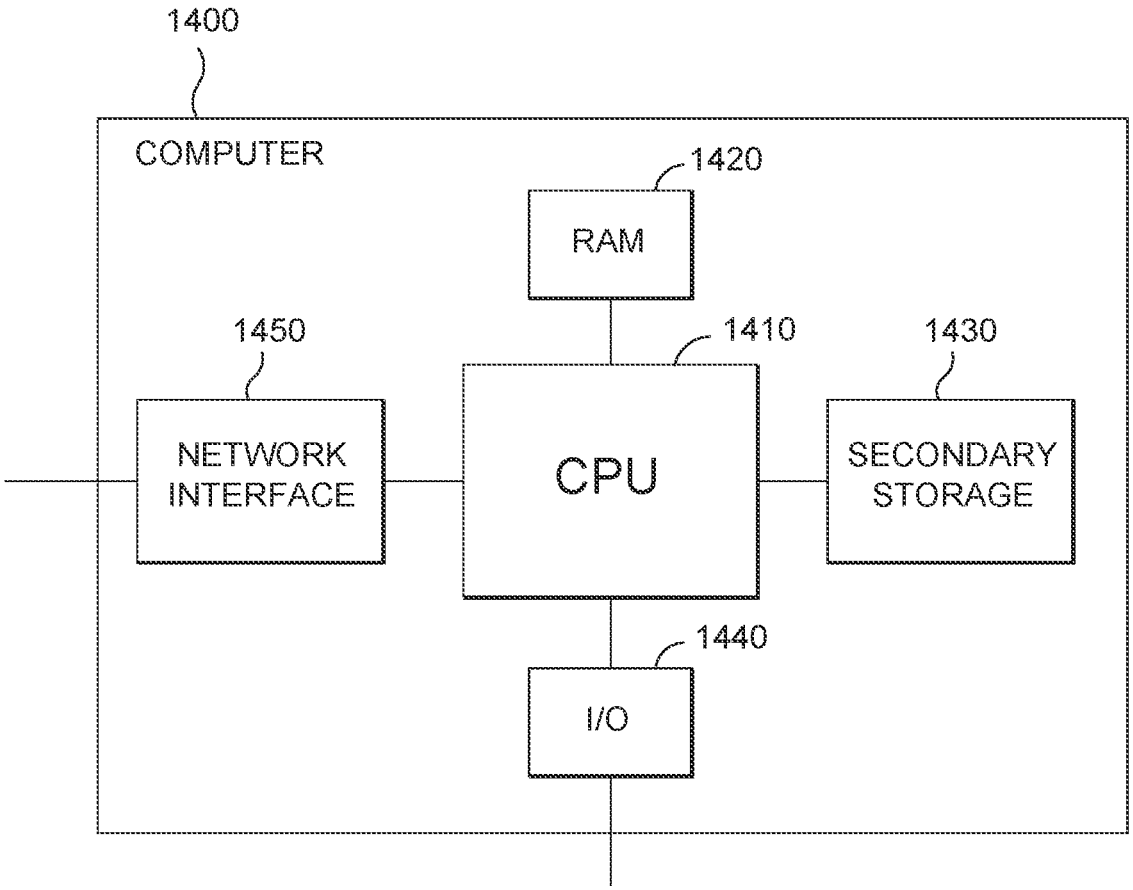
FIG. 14 shows an example of a computer in which the horse race betting apparatus of FIG. 8, the operational flow of FIG. 10, the horse breeding apparatus of FIG. 12, the operational flow of FIG. 13, and/or other embodiments of the disclosure may be wholly or partly embodied.

FIG. 14 shows an example of a computer 1400 in which the horse race betting apparatus 800 of FIG. 8, the horse breeding apparatus 1200 of FIG. 12, the operational flows of FIGS. 10 and 13, and/or other embodiments of the disclosure may be wholly or partly embodied. As shown in FIG. 14, the computer 1400 may include a processor (e.g. a CPU) 1410, a system memory (e.g. RAM) 1420 that may be connected by a dedicated memory channel to the processor 1410 and temporarily stores results of data processing operations performed by the processor 1410, and a hard drive or other secondary storage device 1430. The processor 1410 may execute one or more computer programs, which may be tangibly embodied along with an operating system in a computer-readable medium, e.g., the secondary storage device 1430. The operating system and computer programs may be loaded from the secondary storage device 1430 into the system memory 1420 to be executed by the processor 1410. The computer 1400 may further include a network interface 1440 for network communication between the computer 1400 and external devices (e.g. over the Internet), such as user devices 801, 1201 accessing the horse race betting GUI 800 or horse breeding GUI 1100 described throughout this disclosure using a mobile application or web browser. Server-side user interaction with the computer 1400 may be via one or more I/O devices 1450, such as a display, mouse, keyboard, etc.

The computer programs may comprise program instructions which, when executed by the processor 1410, cause the processor 1410 to perform operations in accordance with the various embodiments of the present disclosure. For example, a program that is installed in the computer 1400 may cause the computer 1400 to function as an apparatus such as the horse race betting apparatus 800 of FIG. 8 or the horse breeding apparatus of FIG. 12, e.g., causing the computer 1400 to function as some or all of the sections, components, elements, databases, storages, engines, interfaces, modules, updaters, generators, selectors, calculators, etc. of the apparatus 800 of FIG. 8 or the apparatus 1200 of FIG. 12 (e.g., the user I/O interface 810, the GUI updater 820, etc.). A program that is installed in the computer 1400 may also cause the computer 1400 to perform an operational flow such as those shown in FIGS. 10 and 13 or a portion thereof, e.g., causing the computer 1400 to perform one or more of the steps of FIG. 10 (e.g., display list(s) of horses 1006, select ancestry-derived ratings 1008, etc.) and/or FIG. 13 (e.g., query database to obtain horse data 1304, derive ancestry-derived ratings 1306, etc.).

The above-mentioned computer programs may be provided to the secondary storage 1430 by or otherwise reside on an external computer-readable medium such as a DVD-ROM, an optical recording medium such as a CD or Blu-ray Disk, a magneto-optic recording medium such as an MO, a semiconductor memory such as an IC card, a tape medium, a mechanically encoded medium such as a punch card, etc. Other examples of computer-readable media that may store programs in relation to the disclosed embodiments include a RAM or hard disk in a server system connected to a communication network such as a dedicated network or the Internet, with the program being provided to the computer 1400 via the network. Such program storage media may, in some embodiments, be non-transitory, thus excluding transitory signals per se, such as radio waves or other electromagnetic waves. Examples of program instructions stored on a computer-readable medium may include, in addition to code executable by a processor, state information for execution by programmable circuitry such as a field-programmable gate arrays (FPGA) or programmable logic array (PLA).

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A non-transitory program storage medium on which are stored instructions executable by a processor or programmable circuit to perform operations for generating a graphical user interface for horse race betting, the operations comprising:

displaying a race selection tool by which a user of the graphical user interface may select a horse race;

in response to a user interaction with the race selection tool, querying a database of race data to obtain race data associated with a selected race, the race data including a list of horses scheduled to run the selected race, a track surface associated with the selected race, and a distance of the selected race;

displaying the list of horses;

for each horse from among the list of horses, selecting a rating corresponding to the horse, the track surface, and the distance, the rating being selected from a plurality of ratings quantifying an expected performance of the horse for different combinations of track surface and distance and being derived from data associated with a sire and/or a dam of the horse;

for each horse from among the list of horses, selecting an overall rating corresponding to the horse and the track surface, the overall rating being selected from a plurality of overall ratings quantifying an expected performance of the horse for different combinations of track surface irrespective of distance and being derived from data associated with a sire and/or a dam of the horse; and displaying the selected ratings and the selected overall ratings in association with the horses.

2. The non-transitory program storage medium of claim 1, wherein the operations further comprise displaying a button by which the user may navigate to a detailed view of data associated with one of the horses, the detailed view including the plurality of ratings for the horse organized according to track surface and distance.

3. The non-transitory program storage medium of claim 2, wherein the selected rating is highlighted in the detailed view.

4. The non-transitory program storage medium of claim 2, wherein the plurality of ratings included in the detailed view are organized in a grid.

5. The non-transitory program storage medium of claim 4, wherein the grid has rows and columns corresponding to distance and track surface, respectively.

6. The non-transitory program storage medium of claim 5, wherein the columns of the grid are displayed in separate tabs selectable by the user.

7. The non-transitory program storage medium of claim 6, wherein the operations further comprise:

for each of the tabs associated with a corresponding track surface, selecting the overall rating corresponding to the horse and the track surface from among the plurality of overall ratings; and displaying each of the overall ratings on the tab associated with the corresponding track surface.

8. The non-transitory program storage medium of claim 4, wherein the grid has a first dimension corresponding to distance and a second dimension corresponding to track surface.

9. The non-transitory program storage medium of claim 8, wherein the second dimension of the grid is displayed in separate tabs selectable by the user corresponding to different track surfaces.

10. The non-transitory program storage medium of claim 9, wherein the operations further comprise:

for each of the tabs associated with a corresponding track surface, selecting the overall rating corresponding to the horse and the track surface from among the plurality of overall ratings; and displaying each of the overall ratings on the tab associated with the corresponding track surface.

11. The non-transitory program storage medium of claim 1, wherein the plurality of ratings for each horse are two-digit numbers.

12. The non-transitory program storage medium of claim 1, wherein the plurality of ratings for each horse are derived from ancestry data of the horse going back three or more generations.

13. The non-transitory program of claim 12, wherein the plurality of ratings for each horse are further derived from performance data of the horse.

14. The non-transitory program storage medium of claim 1, wherein the operations further comprise:

displaying an automatic ticket generation button by which the user may request an automatic selection of horses to generate a horse race betting ticket; and, in response to a user interaction with the automatic ticket generation button, marking one or more of the horses as selected to win the race based at least in part on the selected ratings.

15. A method of generating a graphical user interface for horse race betting, the method comprising:

displaying a race selection tool by which a user of the graphical user interface may select a horse race;

in response to a user interaction with the race selection tool, querying a database of race data to obtain race data associated with a selected race, the race data including a list of horses scheduled to run the selected race, a track surface associated with the selected race, and a distance of the selected race;

displaying the list of horses;

for each horse from among the list of horses, selecting a rating corresponding to the horse, the track surface, and the distance, the rating being selected from a plurality of ratings quantifying an expected performance of the horse for different combinations of track surface and distance and being derived from data associated with a sire and/or a dam of the horse;

for each horse from among the list of horses, selecting an overall rating corresponding to the horse and the track surface, the overall rating being selected from a plurality of overall ratings quantifying an expected performance of the horse for different combinations of track surface irrespective of distance and being derived from data associated with a sire and/or a dam of the horse; and displaying the selected ratings and the selected overall ratings in association with the horses.

16. The method of claim 15, further comprising displaying a button by which the user may navigate to a detailed view of data associated with one of the horses, the detailed view including the plurality of ratings for the horse organized according to track surface and distance.

17. The method of claim 16, wherein the plurality of ratings included in the detailed view are organized in a grid.

18. The method of claim 17, wherein the grid has a first dimension corresponding to distance and a second dimension corresponding to track surface.

19. The method of claim 18, wherein the second dimension of the grid is displayed in separate tabs selectable by the user corresponding to different track surfaces.

20. A system for generating a graphical user interface for horse race betting, the system comprising:

one or more servers in communication with a user device; and one or more program storage media on which are stored instructions executable by the one or more servers to perform operations for generating a graphical user interface accessible by the user device via a web browser or mobile application of the user device, the operations comprising:

displaying a race selection tool by which a user of the graphical user interface may select a horse race;

in response to a user interaction with the race selection tool, querying a database of race data to obtain race data associated with a selected race, the race data including a list of horses scheduled to run the selected race, a track surface associated with the selected race, and a distance of the selected race;

displaying the list of horses;

for each horse from among the list of horses, selecting a rating corresponding to the horse, the track surface, and the distance, the rating being selected from a plurality of ratings quantifying an expected performance of the horse for different combinations of track surface and distance and being derived from data associated with a sire and/or a dam of the horse;

for each horse from among the list of horses, selecting an overall rating corresponding to the horse and the track surface, the overall rating being selected from a plurality of overall ratings quantifying an expected performance of the horse for different combinations of track surface irrespective of distance and being derived from data associated with a sire and/or a dam of the horse; and displaying the selected ratings and the selected overall ratings in association with the horses.

21. A non-transitory program storage medium on which are stored instructions executable by a processor or programmable circuit to perform operations for generating a graphical user interface for horse racing, the operations comprising:

selecting a plurality of ratings quantifying an expected performance of a horse for different combinations of track surface and distance, the plurality of ratings being derived from data associated with a sire and/or a dam of the horse; and displaying a button by which a user of the graphical user interface may navigate to a detailed view of data associated with the horse, the detailed view including the plurality of ratings organized according to track surface and distance.

22. A method of generating a graphical user interface for horse racing, the method comprising:

selecting a plurality of ratings quantifying an expected performance of a horse for different combinations of track surface and distance, the plurality of ratings being derived from data associated with a sire and/or a dam of the horse; and displaying a button by which a user of the graphical user interface may navigate to a detailed view of data associated with the horse, the detailed view including the plurality of ratings organized according to track surface and distance.

23. A system for generating a graphical user interface for horse racing, the system comprising:

one or more servers in communication with a user device; and one or more program storage media on which are stored instructions executable by the one or more servers to perform operations for generating a graphical user interface accessible by the user device via a web browser or mobile application of the user device, the operations comprising:

selecting a plurality of ratings quantifying an expected performance of a horse for different combinations of track surface and distance, the plurality of ratings being derived from data associated with a sire and/or a dam of the horse; and displaying a button by which a user of the graphical user interface may navigate to a detailed view of data associated with the horse, the detailed view including the plurality of ratings organized according to track surface and distance.

* * * * *